US006734382B2

(12) United States Patent
Arai et al.

(10) Patent No.: US 6,734,382 B2
(45) Date of Patent: May 11, 2004

(54) INDICATOR PORTION FORMING METHOD FOR PUSH SWITCH AND PUSH SWITCH HAVING AN INDICATOR PORTION

(75) Inventors: Hiroshi Arai, Tokyo (JP); Yoshifumi Honmatsu, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 10/446,194

(22) Filed: May 28, 2003

(65) Prior Publication Data

US 2003/0221944 A1 Dec. 4, 2003

(30) Foreign Application Priority Data

May 31, 2002 (JP) ..... 2002-160672
May 31, 2002 (JP) ..... 2002-160673

(51) Int. Cl.[7] ..... H01H 13/70

(52) U.S. Cl. ..... 200/512; 200/517; 200/314; 200/341

(58) Field of Search ..... 29/622; 200/5 A, 200/512, 517, 308, 310, 311, 313, 314, 341, 345

(56) References Cited

U.S. PATENT DOCUMENTS 5,234,744 A * 8/1993 Kenmochi ..... 428/195.1
6,196,738 B1 * 3/2001 Shimizu et al. ..... 400/490
6,224,278 B1 * 5/2001 Nishi ..... 400/495
6,462,294 B2 * 10/2002 Davidson et al. ..... 200/512
6,575,856 B2 * 6/2003 Anderson ..... 474/83
6,621,027 B1 * 9/2003 Shimizu et al. ..... 200/341

FOREIGN PATENT DOCUMENTS

JP 05-090762 A1 12/1993
JP 2000-231849 A1 8/2000

* cited by examiner

*Primary Examiner*—Michael A. Friedhofer
(74) *Attorney, Agent, or Firm*—Rader, Fishman & Grauer PLLC

(57) ABSTRACT

A method for forming an indicator portion on a push switch such as a pushbutton switch or a membrane switch, the indicator portion being excellent in terms of design property and image quality and allowing fine picture patterns, designs, etc. that are difficult to be reproduced with conventional printing systems to be represented with high resolution, and to provide a push switch having the indicator portion. In order to form the indicator portion, in which a color design image such as a letter, a pattern, design etc is indicated, on the push switch, there are performed the following steps of: forming a colorant layer by printing a color design image on a base sheet by a printer; transferring the colorant layer to a transfer resin through an adhesive, the transfer resin constituting a surface of the push switch; and forming the indicator layer on the transfer resin by peeling off the base sheet and using the colorant layer as the indicator layer.

20 Claims, 17 Drawing Sheets

INDICATOR PORTION FORMING METHOD FOR PUSH SWITCH AND PUSH SWITCH HAVING AN INDICATOR PORTION

BACKGROUND OF THE INVENTION

1. Field of the Invention

The present invention relates to a push switch, such as a pushbutton switch used in the operation portion of an electronic apparatus, a portable device, a vehicle-mounted switch, a remote controller etc., or a membrane switch used in an electronic apparatus, for example, as a thin switch input device.

More specifically, the present invention relates to a method for forming, on a pushbutton switch, an indicator portion in which color design images such as letters, patterns, and designs are indicated, and to a pushbutton switch having the indicator portion.

Also, the present invention relates to a method for forming, on a membrane switch, an indicator portion in which color design images such as letters, patterns, and designs are indicated, and a membrane switch having the indicator portion.

2. Description of the Related Art

Pushbutton switches used in electronic apparatuses such as portable telephones have an indicator layer for the indication of color design images such as letters, numerals, figures, symbols, and design patterns. Such an indicator layer is formed by printing shapes corresponding to letters, symbols, or the like on a key top mainly formed of a resin, by screen printing, pad printing, or the like.

However, with the recent trend toward miniaturization and an increase in the functions of electronic apparatuses, key tops of pushbutton switches are also becoming increasingly smaller in size. Thus, there is a need to enable indication of as many letters or numerals as possible, or complex figures, symbols, design patterns, etc. formed using multiple colors, on a small key top having a limited space. Consequently, with the conventional methods such as screen printing or pad printing, it has become increasingly difficult to form an indicator layer which is capable of high resolution, the resolution being a measure of the meticulousness of a drawing or the smoothness of an image, and on which fine, sharp designs are rendered. Further, the screen printing and the pad printing require the use of a printing plate for each color, so that the number of printing steps increases as the number of colors for printing increases, thus necessitating sophisticated printing techniques that enable a fine positional adjustment, or measures for preventing the intrusion of contaminants. Further, when changing the design of a pushbutton switch, it is necessary to prepare new printing plates. Thus, the printing plates are prepared in accordance with colors required for each product, so that a great deal of time, labor, and costs is involved in storing and maintaining the printing plates. Due to the reasons described above, conventional methods based on printing, for example screen printing and pad printing, have proved inadequate to quickly respond to the diversity of designs and shorter life cycles, making it impossible to meet such demands as the simplification of the production steps, reduction in cost, and higher resolution.

In contrast, as an alternative method for preparing an indicator layer on a pushbutton switch to the conventional printing methods, there is a method of bonding onto a key top a photographic sheet formed on a resin sheet by graphic photo-printing using a printer. A similar technique is described in JP 2000-231849 A. However, with the above method, it is necessary to perform a post-processing of cutting the photographic sheets along the outer peripheral configurations of individual key tops using a carbon dioxide laser or a punching edge. In addition, because a rather thick photographic sheet is cut, burrs are easily produced on the cut surfaces. Further, the photographic sheet is integrated with the key top, making the above method unsuitable for dealing with the demand for reduced thickness.

Membrane switches are used as thin switch input devices in, for example, electronic apparatuses. An example of conventional membrane switches is shown in FIGS. 17 and 18. Such a conventional membrane switch, denoted 100, commonly has a construction as shown in FIGS. 17 and 18. That is, the membrane switch is generally composed of a front-side film, or sheet material 101 that is exposed to the outward appearance of a not-shown electronic apparatus, a back-side film, or sheet material 102 received within the inner portion of the electronic apparatus, and a spacer 103 arranged between the two film materials. Formed on the two sheet materials 101 and 102 are contact electrodes 101*a* and 102*a*, respectively. When pressed from above, the contact electrode 101*a* of the front-side sheet material 101 is brought into conducting contact with the contact electrode 102*a* of the back-side sheet material 102 by way of a through hole 103*a* formed in the spacer 103. Establishing such conducting contact makes it possible to attain a predetermined switch function of the electronic apparatus. Advantages of the membrane switch 100 described above reside in the simplicity of its construction and its small thickness. As such, the switch is employed in various apparatuses as a switch input device of an electrical apparatus for which there is a particularly strong demand for miniaturization.

In such a membrane switch 100, in general, letters, numerals, symbols, figures etc. are colors for indication or a colored exterior film 104 is bonded onto a portion thereof which is exposed to the outward appearance of the electronic apparatus. Such an exterior film 104 is typically obtained by screen-printing a coating material onto a resin film. However, with screen printing, it is necessary to prepare a printing plate for each color, which places a large burden in terms of both labor and cost. Further, when changing the design, it is necessary to prepare all new printing plates from scratch, which leads to a further increase in labor and cost. To overcome the above problem, there is proposed a method for forming the exterior film 104 which includes: preparing a design by a personal computer; printing the design on a base sheet (not shown) such as paper or a PET film using a commercially available color printer to thereby prepare the external film 104; and stacking the exterior film 104 on the front-side film material 101 using an adhesive tape or the like (for a similar technique, see Japanese Utility Model Application Laid-open No. Hei 5-90762).

However, with the above-described method, it is also necessary to perform a step of cutting the exterior film 104 along the outer peripheral configurations of individual membrane switches using a carbon dioxide laser or a punching edge. In addition, burrs are easily generated resulting from the cutting step. Further, with the above-described method, it is commonly necessary to provide a protection sheet for protecting the printing surface subjected to printing using a color printer, which leads to a considerable increase in the overall thickness inclusive of the thickness of the base sheet. If the resulting structure is integrated as a part of the membrane switch, the flexibility of a portion subjected to pressing operation with, for example fingers is impaired, resulting in such problems that the operational feel as a membrane switch is degraded, on/off operation of the switch is not properly effected by the pressing operation, and the like. Therefore, the above-described method is not suitable for application to membrane switches whose structural advantages reside in their small thicknesses. On the other hand, to avoid the problem described above, the printing surface subjected to printing by a color printer may be bonded onto a portion that is exposed to the outward appearance of the electronic apparatus. With this arrangement, however, the color design image is viewed from the back (from the side opposite to the printing surface), so that the image appears distorted. Thus, it is often difficult to view the image with good reproducibility while maintaining high resolution.

SUMMARY OF THE INVENTION

The present invention enables forming an indicator portion having an excellent design image, on a push switch such as a pushbutton switch or a membrane switch.

That is, an object of the present invention is to inexpensively provide an indicator portion for pushbutton switch which enables indication of a large number of letters, symbols, or complex, fine picture patterns, design etc. with clarity and high resolution, allows a reduction in the number of manufacturing steps without requiring sophisticated printing techniques etc., and results in excellent design property and image quality.

Another object of the present invention is to provide an indication portion for a membrane switch, in which letters, symbols, or patterns etc. serving as input elements exposed to the outward appearance of an apparatus has high resolution while exhibiting excellent design property and image quality, and a membrane switch having the indicator portion.

To achieve the above objects, according to the present invention, there is provided an indicator portion forming method for a push switch, in which an indicator portion indicating a color design image such as a letter, a pattern, or a design is formed on the push switch, the method including: forming a colorant layer by printing a color design image on a base sheet by a printer; transferring the colorant layer to a transfer resin through an adhesive, the transfer resin constituting a surface of the push switch; and forming an indicator layer on the transfer resin by peeling off the base sheet and using the colorant layer as the indicator layer.

According to the indicator portion forming method for a push switch, the method performs the steps of: forming a colorant layer by printing a color design image on a base sheet by a printer; transferring the colorant layer to a transfer resin through an adhesive, the transfer resin constituting a surface of the push switch; and forming an indicator layer on the transfer resin by peeling off the base sheet and using the colorant layer as the indicator layer. As a result, an inexpensive, high-quality indicator portion can be obtained which allows a large number of letters, numerals, figures, symbols etc., or patterns of complex configurations with multiple colors to be indicated with sharp clarity on a small area of the push switch surface and which can be produced in a stable manner without relying on the skill of an operator.

Further, according to the present invention, there is provided an indicator portion forming method for a push switch, in which the push switch is a pushbutton switch having a key top made of resin and the transfer resin is a key top main body of the pushbutton switch. According to the indicator portion forming method for a push switch described above, the base sheet is peeled off after the colorant layer is transferred to the transfer resin. As a result, a pushbutton-switch key top having a thin indicator layer can be obtained. Further, since the method does not involve cutting or punching out the base sheet, the pushbutton-switch key top obtained is of high quality with little generation of burrs. Thus, a pushbutton switch having such a key top is obtained.

Further, according to the present invention, the push switch is a membrane switch including: an operation sheet which is provided with an indicator layer indicating a color design image such as a letter, a pattern, or a design and on which a depressing operation is performed; and a switch portion having contact electrodes provided in opposed positions, the switch portion executing a predetermined switch function when the contact electrodes, that are insulated from each other, are brought into electrical connection by the depressing operation on the operation sheet, and the transfer resin is a translucent film constituting a part of the operation sheet.

When the push switch is formed as a membrane switch, an indicator layer having excellent resolution representing the meticulousness of a drawing or the smoothness of an image can be formed on the membrane switch stably and inexpensively without using complex printing techniques. As a result, a high-quality membrane switch can be obtained. In particular, since the base sheet is peeled off in the course of forming the operation sheet of the membrane switch, the operation sheet can be reduced in thickness, thereby making it possible to obtain a membrane switch with a good operating feel and an excellent operational accuracy. Further, the colorant layer is transferred, so that the resulting membrane switch has an indicator layer of high quality, which can be formed without requiring cutting or punching out the base sheet after the transfer process and in which few burrs are produced.

Further, according to the present invention, there is provided an indicator portion forming method for a push switch, in which the transfer resin is formed of a transparent or semi-transparent resin and the colorant layer is transferred to a back surface of the transfer resin.

According to the indicator portion forming method for a push switch, the transfer resin is formed of a transparent or semi-transparent resin and the colorant layer is transferred to the back surface of the transfer resin. As a result, even when the colorant layer is transferred, a color design image outputted by a printer can be viewed from the front side (the printing surface side), thereby making it possible to form an image such as a letter, a symbol, a pattern etc. having high resolution and high appearance quality. Where the image is viewed from the side opposite to the printing surface side, ink smears onto the base sheet or a receiving layer and the like formed on the base sheet, so that there are cases where a surface with ink smeared thereon is viewed. Therefore, it is considered that viewing an image from the printing surface side results, in many cases, in a resolution superior to that obtained when the image is viewed from the side opposite to the printing surface.

Further, according to the present invention, there is provided an indicator portion forming method for a push switch, in which the base sheet has an image bearing layer and the colorant layer is formed by printing a color design image on the image bearing layer by using a printer.

According to the indicator portion forming method for a push switch, the base sheet has an image bearing layer and the colorant layer is formed by printing a color design image on the image bearing layer by using, a printer, thereby making it possible to reproduce an image having excellent resolution with excellent adherence and absorption of a colorant such as ink or toner. Further, in addition to having an indicator layer of excellent water resistance and weatherability in which the colorant is protected with the image bearing layer, because the colorant layer can be transferred onto the transfer resin side with accuracy, the push button obtained has high appearance quality and is excellent in terms of resolution and image quality. In particular, if the image bearing layer is formed of a porous material having a binding phase composed of inorganic particles that are bound by a binder resin, a push switch is obtained which is excellent in terms of transfer property with little generation of burrs even when removing the base sheet, as well as in terms of ink absorption, storage stability of the indicator layer, and appearance quality of the obtained image. Further, if the image bearing layer is provided with a large number of longitudinal pores opening in a direction normal to the base sheet surface, the image bearing layer is readily exfoliated upon the transfer and is therefore excellent in terms of transferability. In particular, when an ink jet printer is used, ink absorption is effected instantaneously due to the strong ink absorption force afforded by the ink jet printer, making it possible to obtain a push switch allowing high appearance quality of the obtained image with no running of ink.

Further, according to the present invention, there is provided an indicator portion forming method for a push switch, the method including forming an auxiliary coloring layer for adding such colorations as metallic colors like gold, silver etc., or a white color.

According to the indicator portion forming method for a push switch, the method includes performing the step of forming the auxiliary coloring layer for adding such colorations as metallic colors like gold, silver etc., or a white color. Therefore, an image having colorations such as metallic colors like gold, silver etc, or white, pearl etc., which are difficult to reproduce with a color printer that typically uses CMYK ink, can be easily formed, whereby an indicator portion with good color reproducibility which is excellent in terms of image quality and design can be obtained. In particular, it is possible to perform the step of forming an auxiliary coloring layer, which serves to add such colorations as metallic colors like gold, silver etc., or a white color, on a transfer resin or on a colorant layer before or after the colorant layer is transferred onto the transfer resin.

Further, according to the present invention, there is provided an indicator portion forming method for a push switch, in which the adhesive is a transparent or semi-transparent hot-melt adhesive, and the transfer of the colorant layer is effected by thermal transfer.

According to the indicator portion forming method for a push switch, the transfer of the colorant layer is effected by thermal transfer using a transparent or semi-transparent hot-melt adhesive, whereby the curing time of the adhesive is shortened and the transfer process is completed instantaneously to achieve good operability and high productivity, and further high operational efficiency is attained since there is no need to additionally provide a step for curing the adhesive. Additionally, the method ensures high quality, little generation of burrs etc., and excellent yield since it allows a desired portion to be transferred onto the transfer resin with accuracy. Further, a push switch having the indicator portion that is obtained by the above-described method is formed by using a hot-melt adhesive, so that it is excellent in terms of humidity resistance and storage stability without causing any change in its strength etc. over time. Further, the adhesive used is a transparent or semi-transparent adhesive, so that an illuminated push switch can be obtained which can sufficiently transmit light with no loss of clarity of an image formed on the indicator layer.

Further, according to the present invention, there is provided an indicator portion forming method for a push switch, the method including printing a color design image by using a printer employing an ink jet printing system.

According to the indicator portion forming method for a push switch, an ink jet printer is used as the printer, whereby full color representation and high speed printing are facilitated, thus allowing instantaneous imaging of color design data. Further, there can be obtained an indicator portion realizing a near-photograph image quality and excellent resolution. Further, ink for the ink jet printer is transferred while remaining infiltrated in the porous material, whereby a push switch having an indicator layer that is excellent in terms of weatherability and color developability can be obtained.

Further, according to the present invention, there is provided a push switch having an indicator portion indicating a color design image such as a letter, a pattern, a design etc., characterized by including an indicator layer on a surface of the push switch, the indicator layer being obtained by printing the color design image through an adhesive layer by using a printer.

According to the, push switch, the indicator layer, which is obtained by printing a color design image through an adhesive layer by using a printer, is provided on a surface of the push switch. Therefore, a push switch is obtained which allows a large number of letters, numerals, symbols etc, or patterns of complex configurations with multiple colors to be indicated with sharp clarity and at high resolution on a small area of the push switch surface.

Further, according to the present invention, the push switch may be used as a pushbutton switch having a key top made of resin. Also, according to the present invention, the push switch may be used as a membrane switch including: an operation sheet which is provided with an indicator layer for indicating a color design image such as a letter, a pattern, or a design and on which a depressing operation is performed; and a switch portion having contact electrodes provided in opposed positions, the switch portion executing a predetermined switch function when the contact electrodes that are insulated from each other are brought into conduction by the depressing operation on the operation sheet.

If the push switch is used as a pushbutton switch or a membrane switch, the pushbutton switch or the membrane switch thus obtained has an indicator portion capable of indicating a large number of letters, numerals, symbols etc., or patterns of complex configurations with multiple colors on a surface of the pushbutton switch or the membrane switch. Further, the indication portion can be formed to have a small thickness, so that when it is applied to a membrane switch, there is obtained a membrane switch that provides good operating feel with respect to a depressing operation with no loss of the flexibility of the operation sheet that is subjected to displacement upon the depressing operation.

Further, according to the present invention, there is provided a push switch to be used as a membrane switch in which the operation sheet constitutes a part of the switch portion and contact electrodes are formed on the operation sheet.

According to the membrane switch, the operation sheet constitutes a part of the switch portion, so that there is no need to join the operation sheet having an indicator layer onto the switch portion executing the switch function, and the resulting absence of a joint portion allows a corresponding reduction in layer thickness. Further, the contact electrodes are formed on the operation sheet, so that a flexible film having the contact electrodes provided thereon need not be provided separately from the operation sheet. Therefore, a reduction in layer thickness is achieved as compared with the case where the operation sheet is laminated on the flexible film, whereby a membrane switch is obtained which provides an excellent operating feel with respect to a depressing operation with hardly any no loss of the flexibility of the operation sheet that is subjected to displacement upon the depressing operation.

Further, if the front surface of the push switch is formed of a translucent resin and the indicator layer is formed on the back surface of the translucent resin, a color design image printed by a printer can be viewed from the front side (the printing surface side), thereby making it possible to form an image such as a letter, a symbol, a pattern etc. having high resolution and high appearance quality. Further, if the indicator layer is obtained by printing it on a base sheet having a porous image bearing layer and impregnating ink into the image bearing layer, an image of excellent resolution can be reproduced which is excellent in terms of ink absorption and formed of dots that are closer to regular circles. Further, in addition to having an indicator layer of excellent water resistance and weatherability in which the colorant constituting ink is protected with the image bearing layer, because the colorant layer can be transferred onto the transfer resin side with accuracy, the push button obtained has high appearance quality and is excellent in terms of resolution and image quality. In particular, if the image bearing layer is formed of a porous material having a binding phase composed of inorganic fine particles that are bound by a binder resin, a push switch is obtained which is excellent in terms of transfer property with little generation of burrs even when removing the base sheet, as well as in terms of ink absorption, storage stability of the indicator layer, and appearance quality of the obtained image. Further, if the image bearing layer is provided with a large number of longitudinal pores opening in a direction normal to the base sheet surface, the image bearing layer is readily exfoliated upon the transfer and is therefore excellent in terms of transferability.

Further, according to the present invention, the push switch may further have an auxiliary coloring layer for adding such colorations as metallic colors like gold, silver etc., or a white color. If the auxiliary coloring layer for adding such colorations as metallic colors like gold, silver etc., or a white color is provided, an image having colorations such as metallic colors like gold or silver, white, pearl etc., which are difficult to reproduce with a color printer that typically uses CMYK ink, can be indicated with sharp clarity, whereby the obtained pushbutton switch has good color reproducibility and is excellent in terms of image quality and design.

Further, if the adhesive layer is formed of a hot-melt adhesive, there can be obtained a push switch realizing near-photograph image quality and excellent resolution.

Further, according to the present invention, there is provided a so-called illuminated push switch in which the respective layers constituting the push switch are translucent so that light exiting from an inner light source can be transmitted therethrough to the exterior for illumination. According to the push switch, the light from the inner light source is transmitted through the push switch to the exterior for illumination, thereby realizing improved decorative property and improved visibility at night or in a dark place.

The foregoing description of the present invention should not be construed restrictively. The objects, advantages, features, and uses of the invention will become more apparent from the following description given with reference to the accompanying drawings. Further, it is to be understood that various modifications made without departing from the gist of this invention fall within the scope of the invention.

DETAILED DESCRIPTION OF THE PREFERRED EMBODIMENTS

A push switch of the present invention may be implemented as one of: a pushbutton switch obtained by joining together a key pad, which is placed on a circuit board having contact electrodes and formed of a rubber-like elastic body, and a key top made of a resin; and a membrane switch including an operation sheet subjected to depressing operation and provided with an indicator layer indicating color design images such as letters, patterns, and designs, and a switch portion having contact electrodes that are arranged in opposed positions and executing a predetermined switch function when the contact electrodes that are insulated are brought into conduction with each other by the depressing operation on the operation sheet. Hereinbelow, a description will be given of each of the embodiment in which the invention is implemented as a pushbutton switch having a key top of a hard resin and the embodiment in which the switch is implemented as a membrane switch. Where no difference exits between the both embodiments, a redundant description will be omitted.

(1) Layer Structure and Manufacturing Method (A) "Pushbutton Switch"

A pushbutton switch of the present invention will be described with reference to the drawings. First, a description will be given of a layer structure and a manufacturing method for a key top of the pushbutton switch.

A key top for pushbutton switch is generally formed by laminating function layers such as an indicator layer, an auxiliary coloring layer, and an adhesive layer for joining those two layers, on the front or back surface of a key top main body formed of a resin. However, the key top may take several different embodiment modes according to differences in relative arrangement of the respective layers.

Embodiment 1

Figure 1:
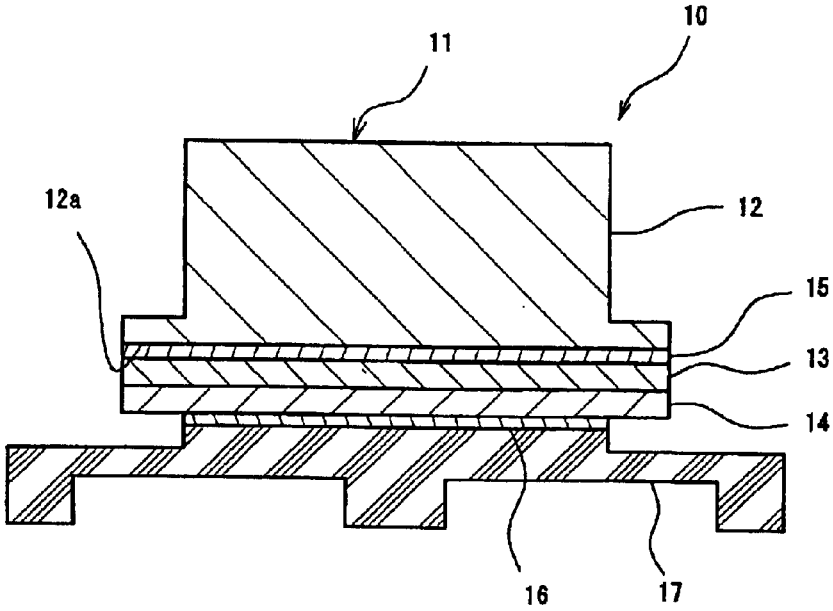
FIG. 1 is a longitudinal sectional view of a pushbutton switch according to Embodiment 1 of the present invention.

FIG. 1 is a longitudinal sectional view of a pushbutton switch 10 that uses a pushbutton-switch key top 11 according to Embodiment 1 of the present invention. On the back surface 12*a* of a key top main body 12 formed of a transparent or semi-transparent resin, an indicator layer 13 for indicating letters, symbols etc. and having transferred thereon a colorant layer obtained by batch output of color design data, and an auxiliary coloring layer 14 for adding such colorations as metallic colors like gold, silver etc. or a white color are laminated through an adhesive layer 15. The pushbutton-switch key top 11 is integrated with a key pad 17 formed of a rubber-like elastic body by using an adhesive 16, thus forming the pushbutton switch 10.

Figure 2A:
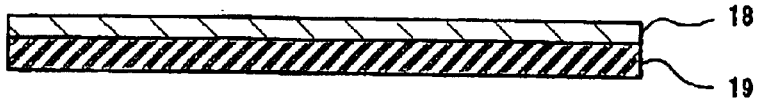
FIGS. 2A through 2E are longitudinal sectional views showing respective steps of manufacturing a key top for the pushbutton switch according to Embodiment 1 of the present invention.
Figure 2B:
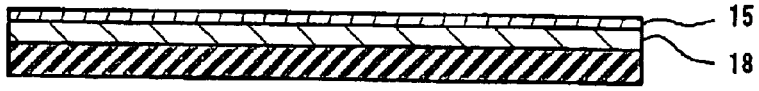
Figure 2C:
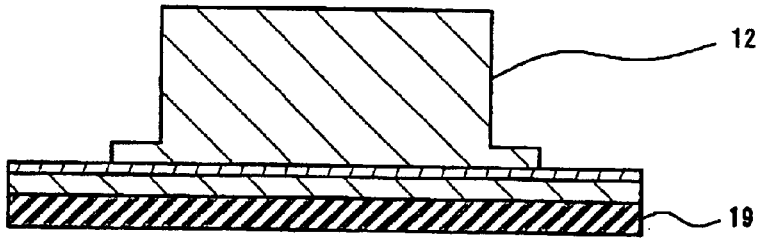
Figure 2D:
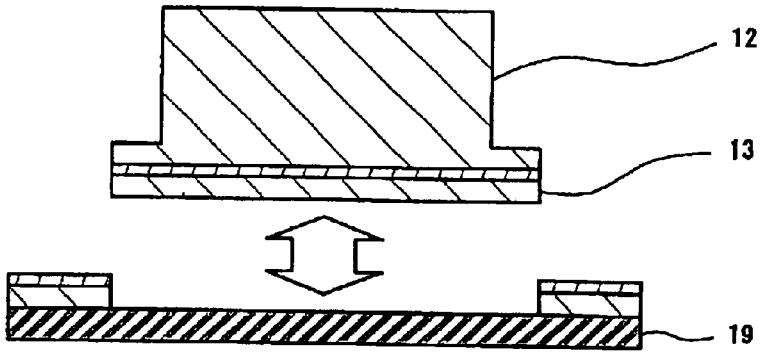
Figure 2E:
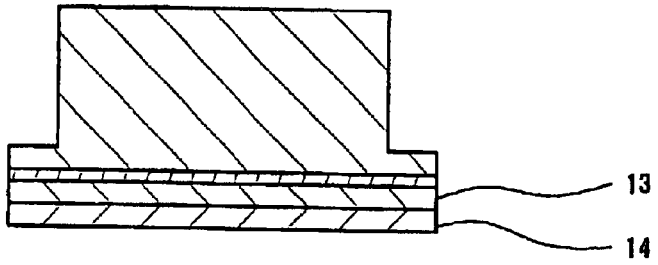

The manufacture of the pushbutton-switch key top 11 according to Embodiment 1 is performed as follows. First, using an output device (not shown) such as a printer capable of performing batch output of color design data, a color design image is printed on a base sheet 19 to form a colorant layer 18 (FIG. 2A). Next, the adhesive 15 is coated on the front surface of the colorant layer 18 or on the back surface 12*a* of the key top main body 12 (FIG. 2B). Thereafter, the base sheet 19 is contact-bonded to the key top main body 12 (FIG. 2C), thereby transferring the colorant layer 18 onto the key top main body 12 from the base sheet 19. Then, the base sheet 19 is peeled off (FIG. 2D). The auxiliary coloring layer 14 is coated on the indicator layer 13 that is transferred and formed on the key top main body 12 (FIG. 2E), thus obtaining the pushbutton-switch key top 11. The key pad 17 is bonded to the obtained pushbutton-switch key top 11, thereby obtaining the pushbutton switch 10.

Figure 3:
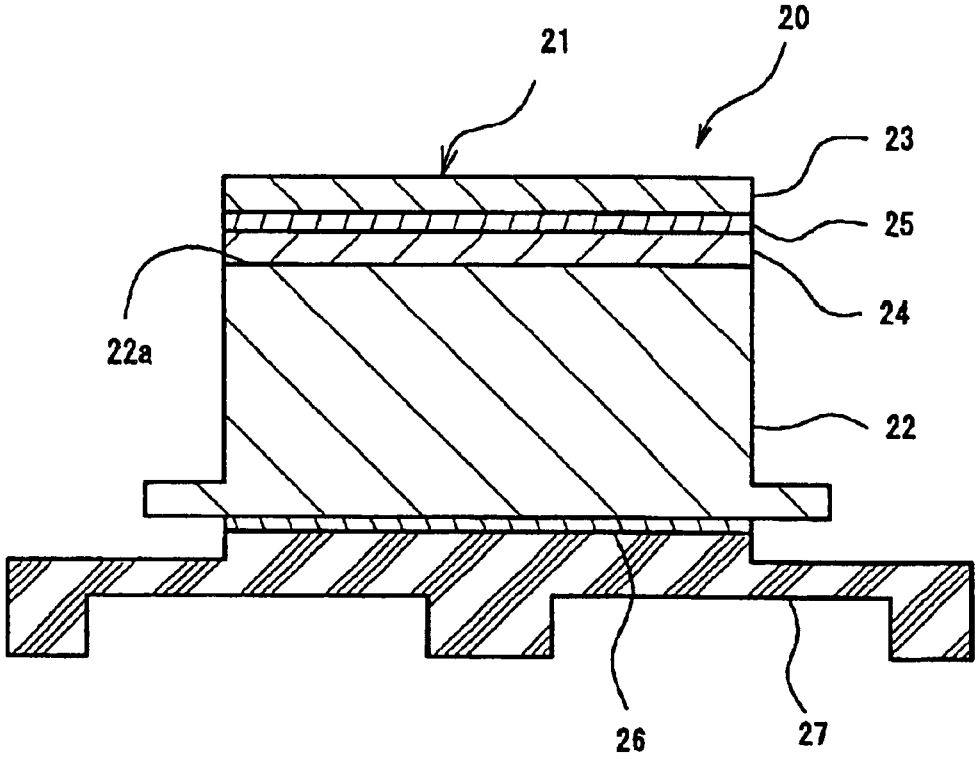
FIG. 3 is a longitudinal sectional view of a pushbutton switch according to Embodiment 2 of the present invention.

Embodiment 2:

FIG. 3 is a longitudinal sectional view of a pushbutton switch 20 that uses a pushbutton-switch key top 21 according to Embodiment 2 of the present invention. Coated on the front surface 22*a* of a key top main body 22 made of a resin is an auxiliary coloring layer 24, on which an indicator layer 23 is laminated through an adhesive layer 25. The pushbutton-switch key top 21 is integrated with a key pad 27 formed of a rubber-like elastic body by using an adhesive 26, thus forming the pushbutton switch 20.

Figure 4A:
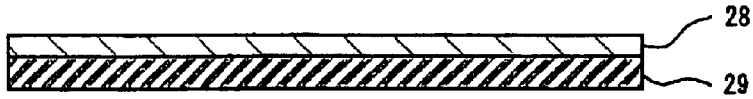
FIGS. 4A through 4E are longitudinal sectional views showing respective steps of manufacturing a key top for the pushbutton switch according to Embodiment 2 of the present invention.
Figure 4B:
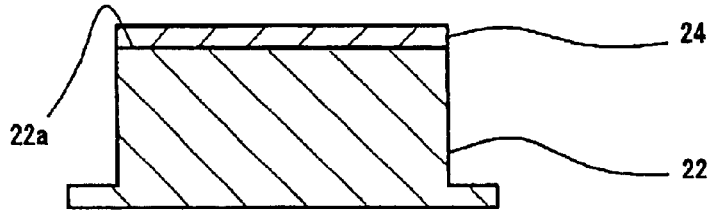
Figure 4C:
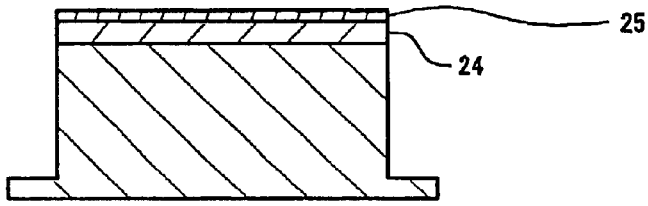
Figure 4D:
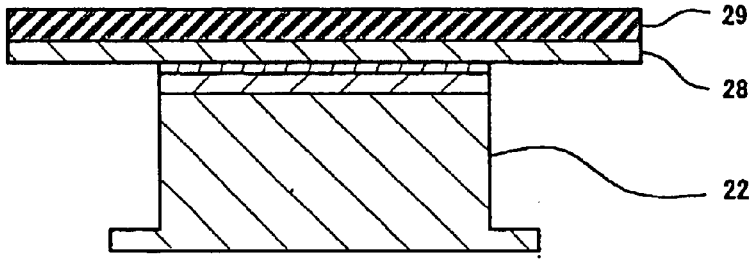
Figure 4E:
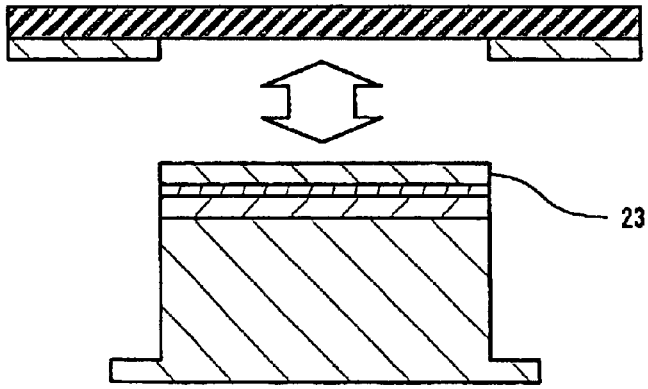

The manufacture of the pushbutton-switch key top 21 according to Embodiment 2 is performed as follows. The process for forming the colorant layer 28 is the same as that of Embodiment 1 (FIG. 4A). In Embodiment 2, first, the auxiliary coloring layer 24 is formed by coating on the front surface 22*a* of the key top main body 22 (FIG. 4B). Next, the adhesive 25 is coated on the auxiliary coloring layer 24 or the colorant layer 28 (FIG. 4C). Thereafter, a base sheet 29 is contact-bonded to the key top main body 22 (FIG. 4D), thereby transferring the colorant layer 28 onto the key top main body 22 from the base sheet 29. Then, the base sheet 29 is peeled off (FIG. 4E). Thus, the pushbutton-switch key top 21 is obtained which has the indicator layer 23 provided on the front surface side of the key top main body 22. The key pad 27 is bonded to the obtained pushbutton-switch key top 21, thereby obtaining the pushbutton switch 20.

Figure 5:
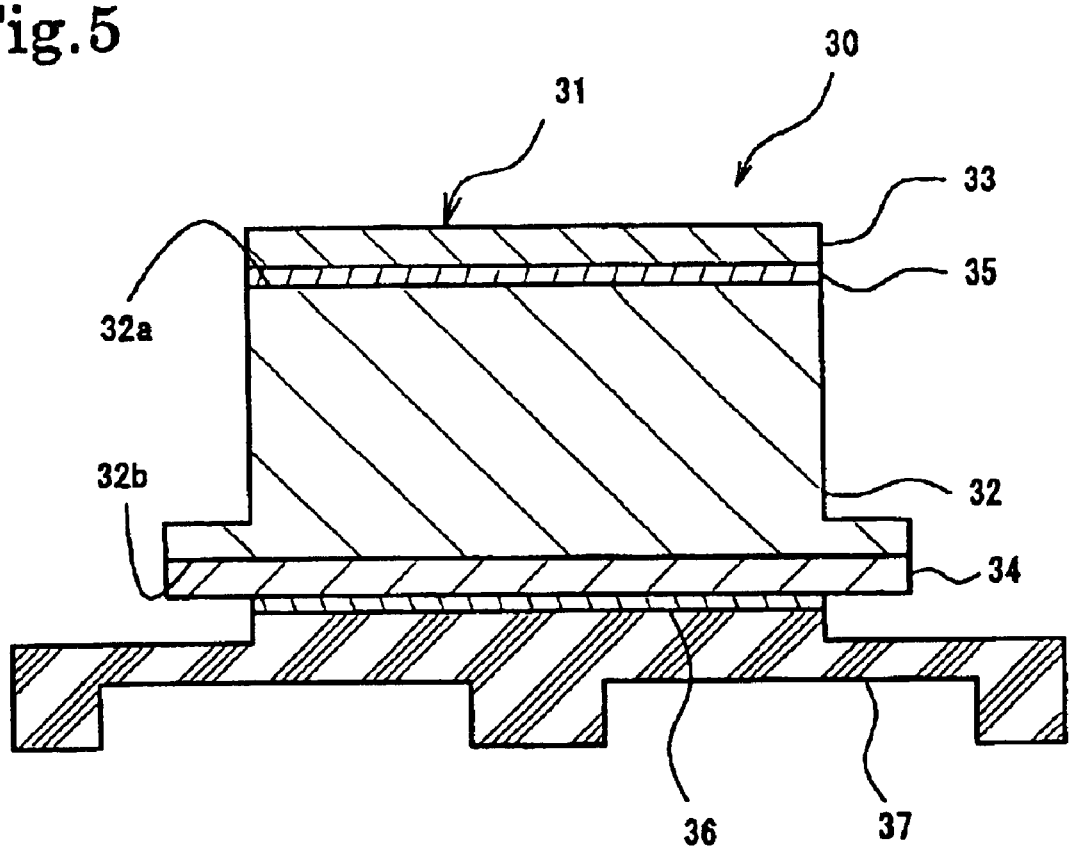
FIG. 5 is a longitudinal sectional view of a pushbutton switch according to Embodiment 3 of the present invention.

Embodiment 3:

FIG. 5 is a longitudinal sectional view of a pushbutton switch 30 that uses a pushbutton-switch key top 31 according to Embodiment 3 of the present invention. An indicator layer 33 is laminated through an adhesive layer 35 on the front surface 32*a* of a key top main body 32 made of a resin. An auxiliary coloring layer 34 is provided on the back surface 32*b* of the key top main body 32. The pushbutton-switch key top 31 is integrated with a key pad 37 formed of a rubber-like elastic body by using an adhesive 36, forming the pushbutton switch 30.

Figure 6A:
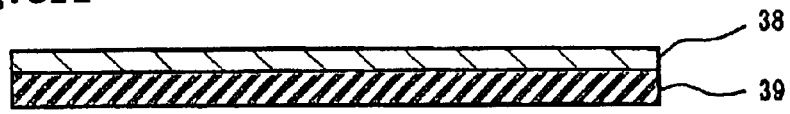
FIGS. 6A through 6E are longitudinal sectional views showing respective steps of manufacturing a key top for the pushbutton switch according to Embodiment 3 of the present invention.
Figure 6B:
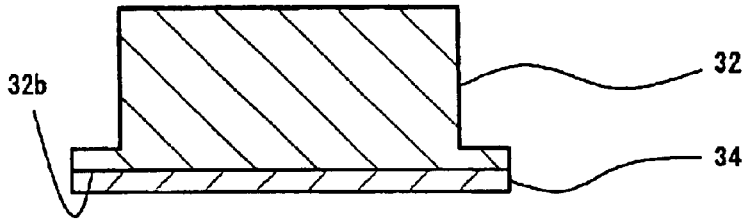
Figure 6C:
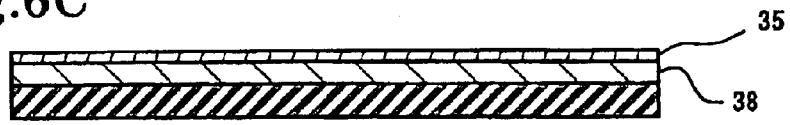
Figure 6D:
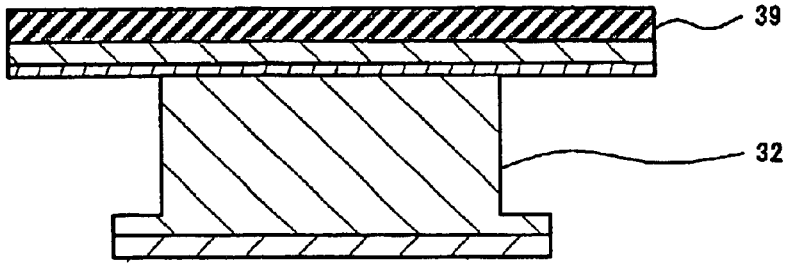
Figure 6E:
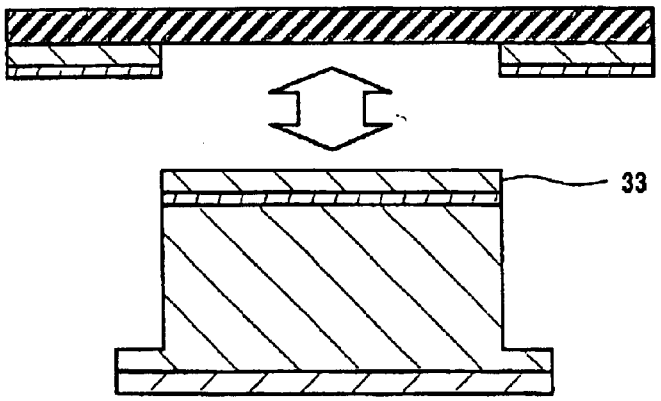

The manufacture of the pushbutton-switch key top 31 according to Embodiment 3 is performed as follows. The process for forming the colorant layer 38 is the same as those of Embodiments 1 and 2 (FIG. 6A). In Embodiment 3, the auxiliary coloring layer 24 is formed by coating on the back surface 32*b* of the key top main body 32 (FIG. 6B). The adhesive 35 is coated either on the front surface 32*a* of the key top main body 32 or on a colorant layer 38 (FIG. 6C). Thereafter, a base sheet 39 is contact-bonded to the key top main body 32 (FIG. 6D), thereby transferring the colorant layer 38 onto the key top main body 32 from the base sheet 39. Then, the base sheet 39 is peeled off (FIG. 6E). Thus, the pushbutton-switch key top 31 has the indicator layer 33 provided on the front surface 32*a* side of the key top main body 32. The key pad 37 is bonded to the obtained pushbutton-switch key top 31, thereby obtaining the pushbutton switch 30.

Figure 7:
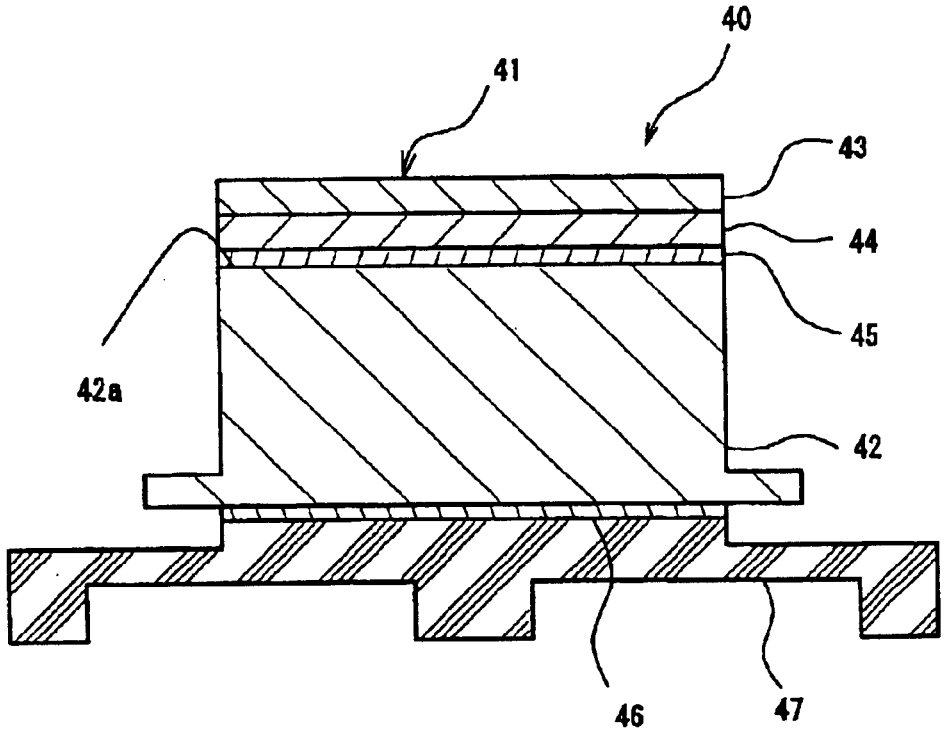
FIG. 7 is a longitudinal sectional view of a pushbutton switch according to Embodiment 4 of the present invention.

Embodiment 4:

FIG. 7 is a longitudinal sectional view of a pushbutton switch 40 that uses a pushbutton-switch key top 41 according to Embodiment 4 of the present invention. An indicator layer 43 and an auxiliary coloring layer 44 are laminated through an adhesive layer 45 on the front side 42*a* of a key top main body 42 made of a resin. The pushbutton-switch key top 41 is integrated with a key pad 47 formed of a rubber-like elastic body by using an adhesive 46, thus forming the pushbutton switch 40.

Figure 8A:
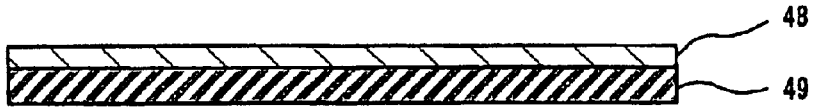
FIGS. 8A through 8E are longitudinal sectional views showing respective steps of manufacturing a key top for the pushbutton switch according to Embodiment 4 of the present invention.
Figure 8B:
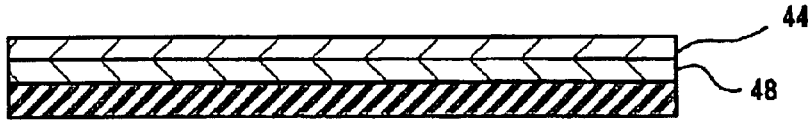
Figure 8C:
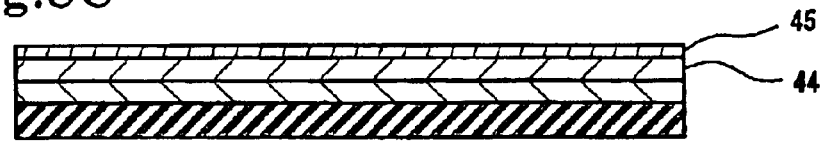

The manufacture of the pushbutton-switch key top 41 according to Embodiment 4 is performed as follows. The process for forming the colorant layer 48 is the same as those of Embodiments 1 through 3 (FIG. 8A). In Embodiment 4, the auxiliary coloring layer 44 is then laminated by coating on the colorant layer 48 (FIG. 8B). Then, the adhesive 45 is coated on the front side 42*a* of the key top main body 42 or on the auxiliary coloring layer 44 (FIG. 8C). Thereafter, a base sheet 49 is contact-bonded to the key top main body 42

Figure 8D:
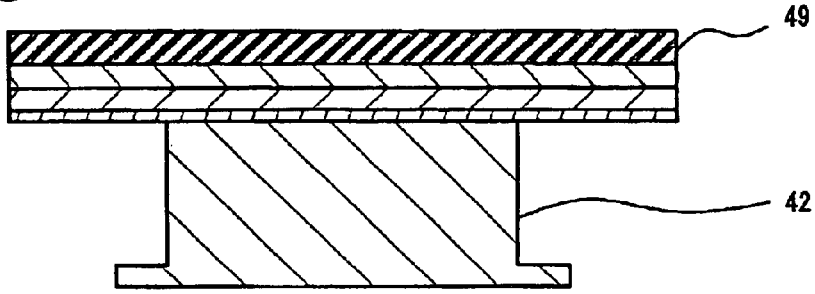
Figure 8E:
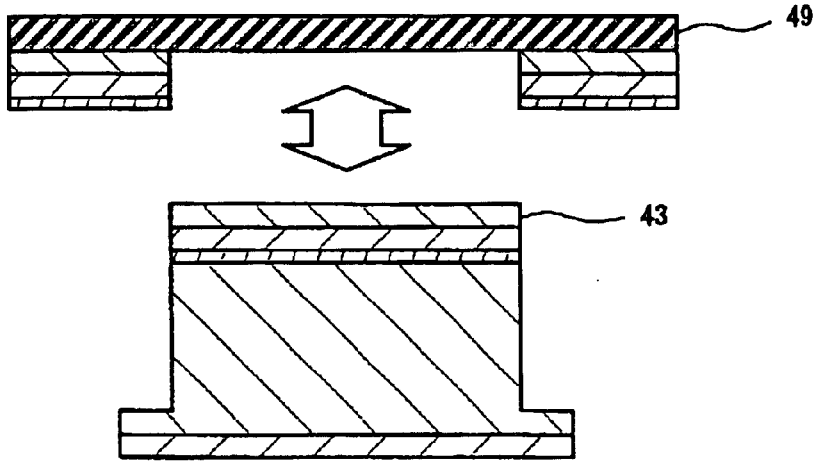

(FIG. 8D), thereby transferring the colorant layer 48 onto the key top main body 42 from the base sheet 49. Then, the base sheet 49 is peeled off (FIG. 8E). Thus, the pushbutton-switch key top 41 is obtained. The key pad 47 is bonded to the obtained pushbutton-switch key top 41, thereby obtaining the pushbutton switch 40.

Other Embodiments:

In addition to the base sheet 19, 29, 39, 49 on which surface treatment is not performed, a release layer can be provided for improving separation between the base sheet 19, 29, 39, 49 and the respective colorant layer 18, 28, 38, 48, or a receiving layer for allowing the colorant layer to be neatly printed may be also formed on the base sheet 19, 29, 39, 49. Further, the auxiliary coloring layer 14, 24, 34, 44 may not be provided unless particularly required. In this case, if the auxiliary coloring layers 24, 34, and 44 are not provided in Embodiments 2 through 4, respectively, the constructions of the key top resulting from those Embodiments will be the same.

As occasion demands, modifications may be made as appropriate to provide a new layer to a part of the construction of the above-described pushbutton-switch key top, such as providing a protection layer for protecting the indicator layer 13, 23, 33, 43 or providing a weatherproof resin layer containing an ultraviolet absorbing agent. Also, in the pushbutton-switch key top 11 according to Embodiment 1, for example, a layer for indicating a given design, pattern, color, or the like may be inserted between the adhesive layer 15 and the key top main body 12 separately from the indicator layer 13. As a result, there may be cases where a step is generated in the key top main body back surface 12*a* when such a layer is formed on the back surface 12*a* of the key top main body 12. However, the generation of such a step can be alleviated if the transfer is performed using a hot-melt adhesive. Hence, the transferability is not affected.

As a method for transferring the colorant material 18, 28, 38, 48 from the base sheet 19, 29, 39, 49 onto the key top main body 12, 22, 32, 42, respectively, thermal transfer is performed in addition to the transfer by contact bonding. The conditions for the thermal transfer depend on such various conditions as the materials and thicknesses of the adhesive layer 15, 25, 35, 45, the key top main body 12, 22, 32, 42 etc., and the air temperature, generally, using a hot-melt adhesive as the adhesive, the base sheet 19, 29, 39, 49 and the key top main body 12, 22, 32, 42 are pressed against each other under the conditions of 150 to 240° C. and 0.3 Mpa for 2 seconds, thereby effecting the transfer.

Figure 9:
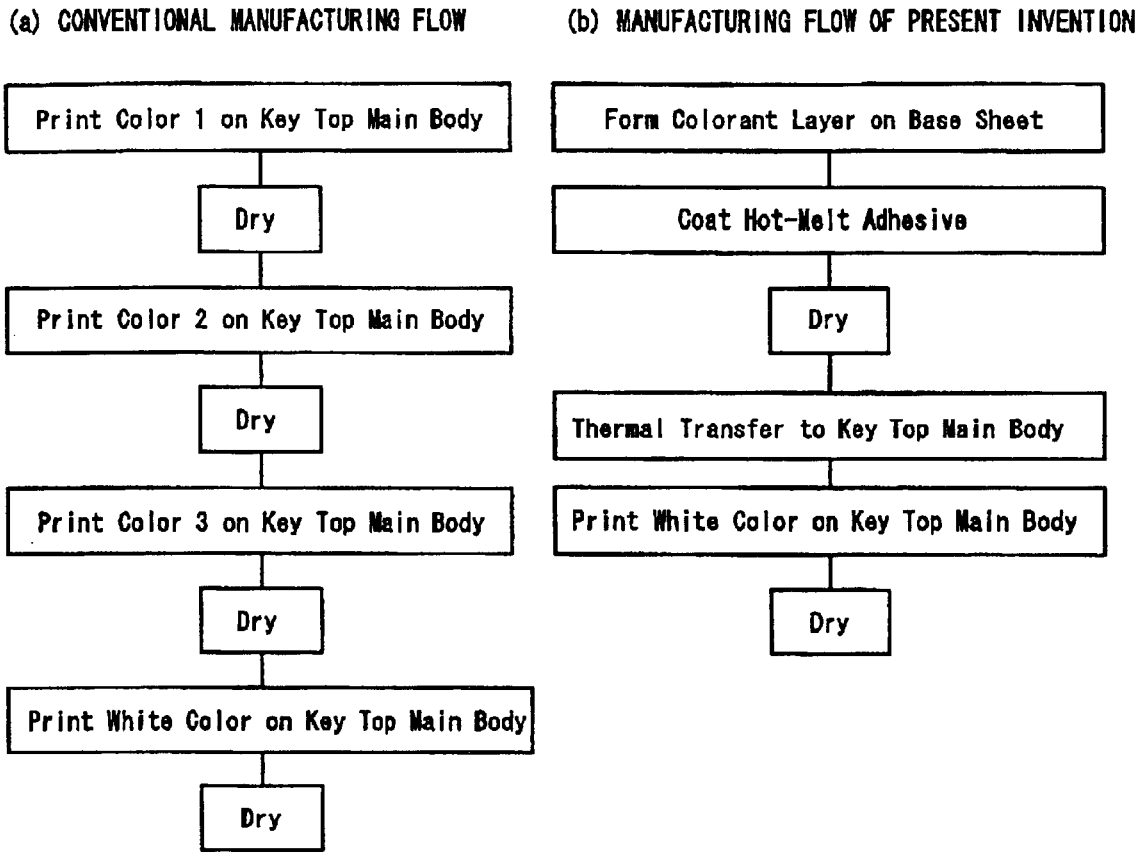
FIG. 9 is a flowchart that compares the indicator portion forming method for a pushbutton switch of the present invention and that for a pushbutton switch of the prior art.

FIG. 9 is a flowchart comparing the steps of forming an indicator layer in each of the pushbutton switch 10 according to Embodiment 1 and a pushbutton switch that is a conventional product. Now, assume a case where the indicator layer 13 composed of three color materials is provided on the key top back surface and the auxiliary coloring layer 14 of white color is provided on the back surface of the key top main body 12. In this case, in the conventional product (a), the printing step is performed for each color, and further the drying process needs to be performed for each color. In contrast, in the product of the present invention (b), the colorant layer 18 for indicating a letter, a pattern, or the like can be formed in a single step, and the indicator layer 13 can be provided by performing thermal transfer thereof onto the key top main body 12 through the hot-melt adhesive 15, thus realizing a significant reduction in the number of steps. The reduction in the number of manufacturing steps will become more pronounced as the number of colors used in a design increases.

(B) "Membrane Switch"

An indicator portion forming method for a membrane switch according to an embodiment of the present invention and a membrane switch having the indication portion will be described with reference to the drawings.

Figure 10:
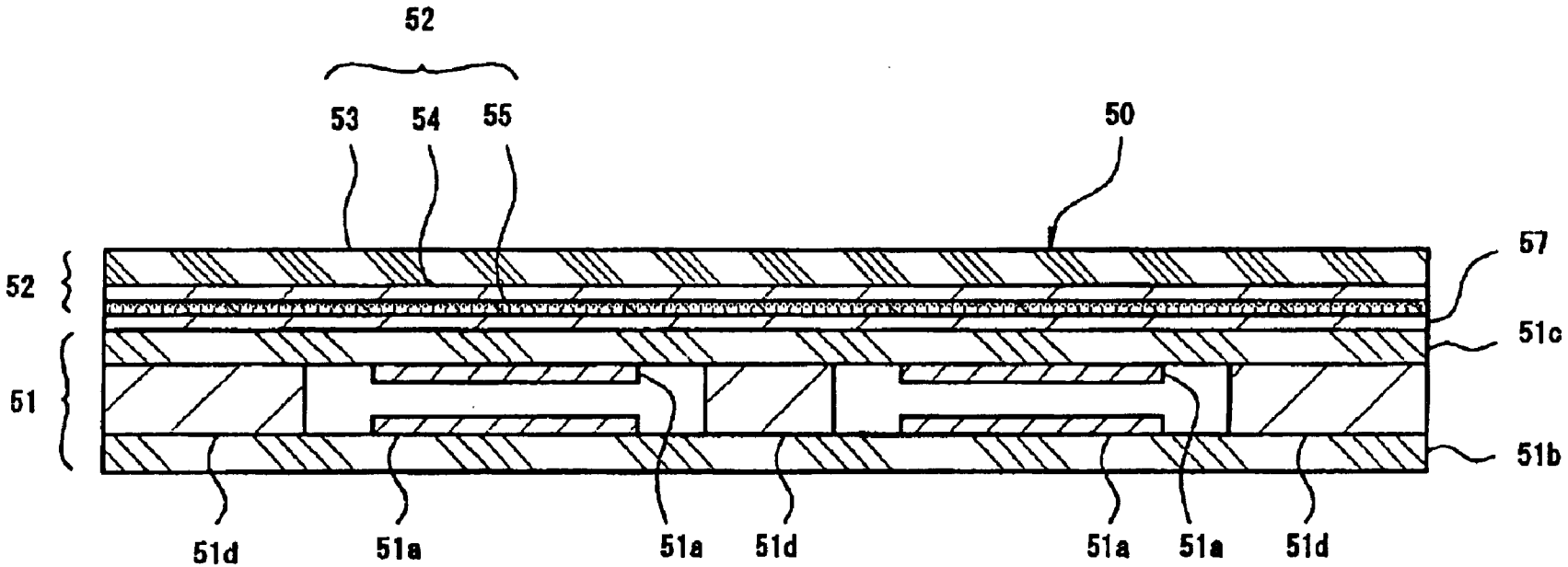
FIG. 10 is a longitudinal sectional view of a membrane switch according to Embodiment 5 of the present invention.

Embodiment 5:

A membrane switch 50 according to an embodiment of the present invention which is shown in FIG. 10 has a switch portion 51 consisting of a laminate structure obtained by integrating together a base film 5*b* having contact electrodes 51*a* formed in a part of a board circuit (not shown) and a flexible film 51*c* having the contact electrodes 51*a* similarly formed thereon, with a spacer 51*b* being provided therebetween. The switch portion 51 is an area where the force generated by a depressing operation on the membrane switch 50 is applied to execute the switch function, thereby generating an electrical signal. Also, the membrane switch 50 has on a surface of the switch portion 51 an operation sheet 52 which is exposed to the outward appearance of the membrane switch 50 and in which input elements such as letters, symbols, figures etc are indicated. The operation sheet 52 is formed by laminating a translucent film 53, a first adhesive layer 54, an indicator layer 55, and, as occasion demands, an auxiliary coloring layer 56. Then, the switch portion 51 and the operation sheet 52 are adhered together through a second adhesive layer 57 to be integrated with each other, thereby forming the membrane switch 50.

Figure 11A:
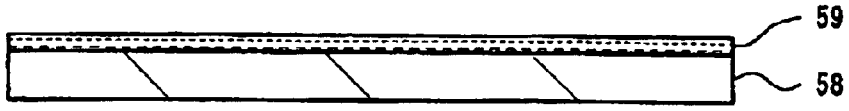
FIGS 11A through 11D are longitudinal sectional views showing respective (first half) steps of manufacturing a key top for the membrane switch according to Embodiment 5 of the present invention.

The operation sheet 52 as a component of the membrane switch 50 is manufactured as follows. First, a color design image such as a letter, a symbol, or a design is printed on a material sheet 58 from an output device (not shown) that performs batch output of color design data stored in a color printer or the like. Then, a colorant layer 59 containing a colorant such as ink or toner is formed on the base sheet 58 (FIG. 11A). In this case, a receiving layer (not shown) for allowing the colorant to be borne on the base sheet 58, a release layer (not shown) for facilitating the transfer of the colorant layer 59, or the like may be also formed in advance.

Figure 11B:
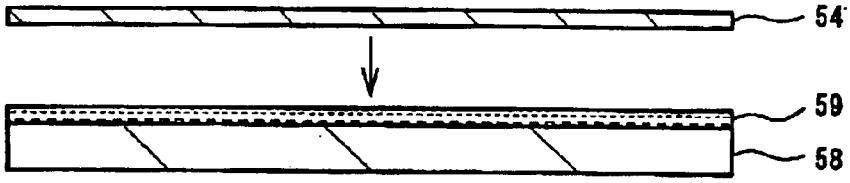
Figure 11C:
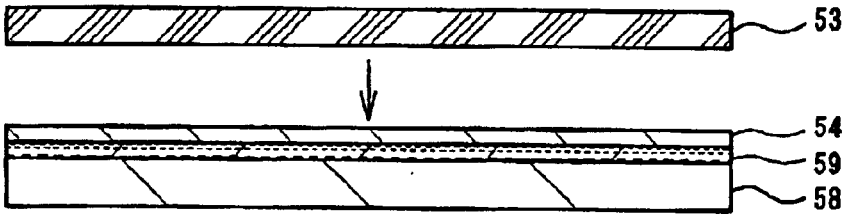
Figure 11D:
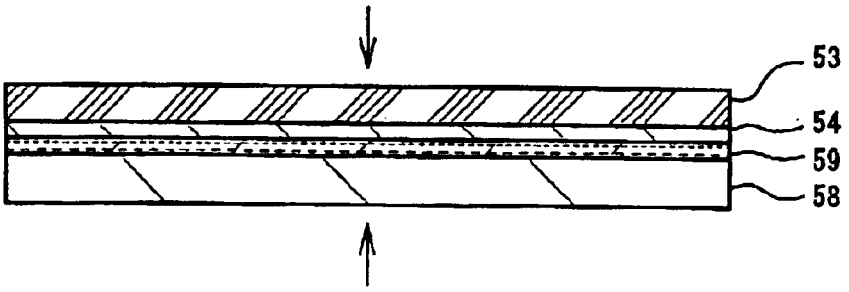
Figure 12A:
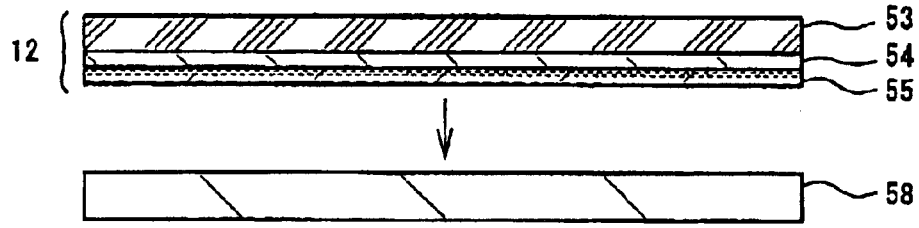
FIGS. 12A through 12C are longitudinal sectional views showing respective (latter half) steps of manufacturing a key top for the membrane switch according to Embodiment 5 of the present invention.

Next, an adhesive serving as the first adhesive layer 54 is coated on a surface of the colorant layer 59 (FIG. 11B). Then, on the base sheet 58 having the respective layers laminated thereon, the translucent film 53 that is transparent or semi-transparent is laminated (FIG. 11C). The colorant layer 59 is then transferred onto the translucent film 53 from the base sheet 58 by application of pressure, heat, or the like (FIG. 11D). Thereafter, the base sheet 58 is peeled off. Upon stripping off the base sheet 58, the transferred colorant layer 59 forms the indicator layer 55 on the translucent film 53. Thus, the operation sheet 52 having the indicator layer 55 provided on the translucent film 53 is obtained (FIG. 12A).

Figure 12B:
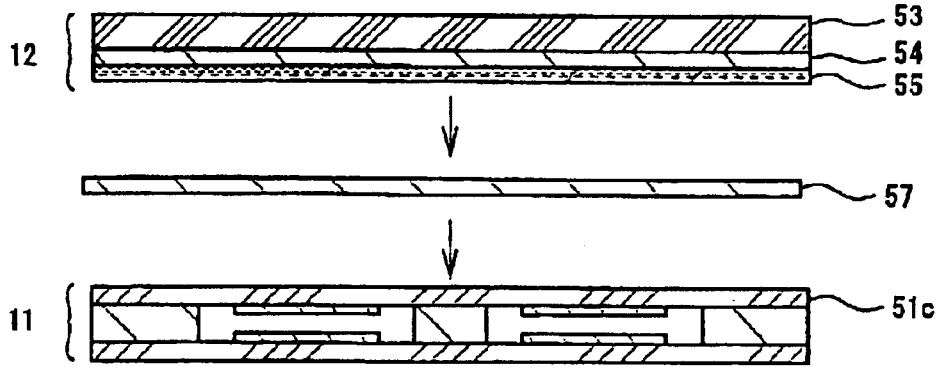
Figure 12C:
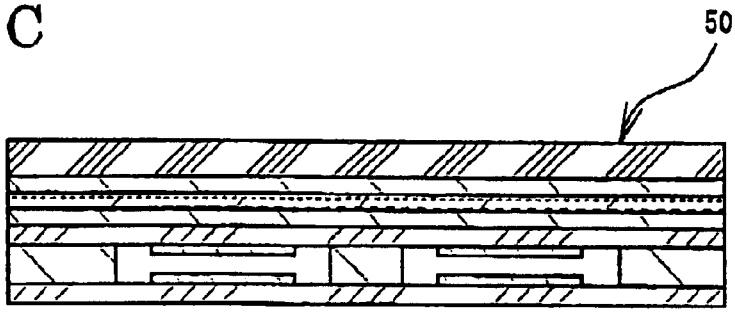

To form the membrane switch 50 using this operation sheet 52, the second adhesive layer 57 is formed on the surface on the indicator layer 55 side of the operation sheet 52 by applying a double-faced tape or an adhesive, and is bonded onto the flexible film 51*c* that constitutes a part of the switch portion 51 of the membrane switch 50 (FIG. 12B). Thus, the membrane switch 50 in which the operation sheet 52 and the switch portion 51 are integrated together is obtained (FIGS. 12C and 10). In the above example, the surface on the indicator layer 55 side is subjected to adhesion so as to ensure that a color design image outputted by the printer can be viewed from the front side (the printing surface side) so that a high-resolution, high-quality image indicative of a letter, a symbol, or a pattern is obtained. Note that, as the switch portion 51 of the membrane switch 50, it is possible to use a switch portion 51 formed by a commonly used technique such as forming the contact electrodes 51*a* by printing conductive ink on a thin film, making the electrodes oppose each other through the spacer 51*d*, and then adhering the electrodes together.

Figure 13:
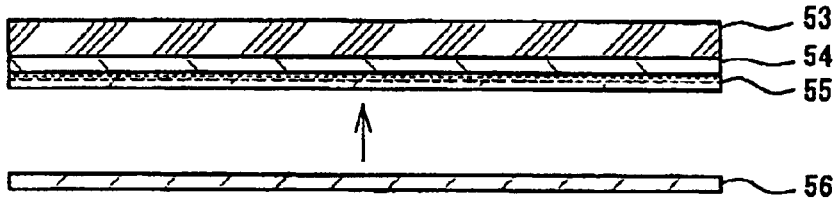
FIG. 13 is a longitudinal sectional view showing the step of forming an auxiliary coloring layer on an operation sheet.

Colorations that are difficult to express with a color printer, for example, metallic colors such as gold and silver, or colorations such as white and pearl, can be indicated with good reproducibility by separately forming the auxiliary coloring layer 56 that serves to add those colors. That is, for example, a step of laminating the auxiliary coloring layer 56 on the indicator layer 55 by screen-printing or the like is performed between the step shown in FIG. 12A and that shown in FIG. 12B described above (FIG. 13). Note that this step is unnecessary if there is no need or desire to form the auxiliary coloring layer 56.

As a method of transferring the colorant material 59 from the base sheet 58 onto the translucent film 53, thermal transfer is performed in addition to the transfer by contact bonding. The conditions for the thermal transfer depend on such various conditions as the materials and thicknesses of the first adhesive layer 54, the translucent film 53 etc, and the air temperature: generally, using a hot-melt adhesive as the adhesive, the base sheet 58 and the translucent film 53 are pressed against each other under the conditions of 150 to 240° C. and 0.3 Mpa for 2 seconds, thereby transferring a desired portion of the colorant layer 59.

In the membrane switch 50 of the present invention, as occasion demands, modifications may be made as appropriate, for example, to provide a new layer such as a weatherproof resin layer containing an ultraviolet absorbing agent to a part of the above-described construction. Also, for example, a layer for indicating a given design, pattern, coloration, etc may be inserted between the first adhesive layer 54 and the translucent layer 53 separately from the indicator layer 53. There may be cases where a step is generated in the translucent film 53 when such a layer is formed on the translucent film 53. However, the generation of such a step can be alleviated if the transfer is performed using a hot-melt adhesive and therefore the transfer property is not affected.

Figure 14:
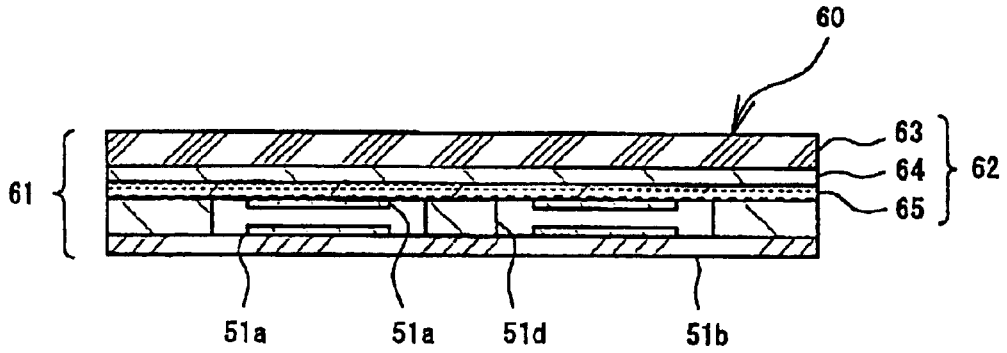
FIG. 14 is a longitudinal sectional view of a membrane switch according to Embodiment 5 of the present invention.

Embodiment 6:

A membrane switch 60 according to another embodiment of the present invention is shown in FIG. 14. While in the membrane switch 50 described in the preceding embodiment the operation sheet 52 is adhered to the flexible film 51*c* of the switch portion 51 that is assembled in advance, in the membrane switch 60, the operation sheet 62 itself is used as a substitute for the flexible film 51*c*. That is, in this case, using the operation sheet 62 formed in the same manner as the operation sheet 52 manufactured by the method described in the above-described embodiment, the contact electrodes 51*a* are formed in this operation sheet 62. Then, the step of integrating the operation sheet 62 with the base film 51*b*, which has the contact electrodes 51*a* formed thereon, while sandwiching the spacer 51*d* therebetween is similarly performed as aforementioned. Thus, the membrane switch 60 having the operation sheet 62 as a part of the switch portion 61 is prepared.

In still another embodiment of the present invention, there may be provided a membrane switch (not shown) in which the indicator layer is formed on the flexible film 51*c* by transferring the colorant layer 59 onto the flexible film 51*c* of the switch portion 51 that is assembled in advance.

Figure 15:
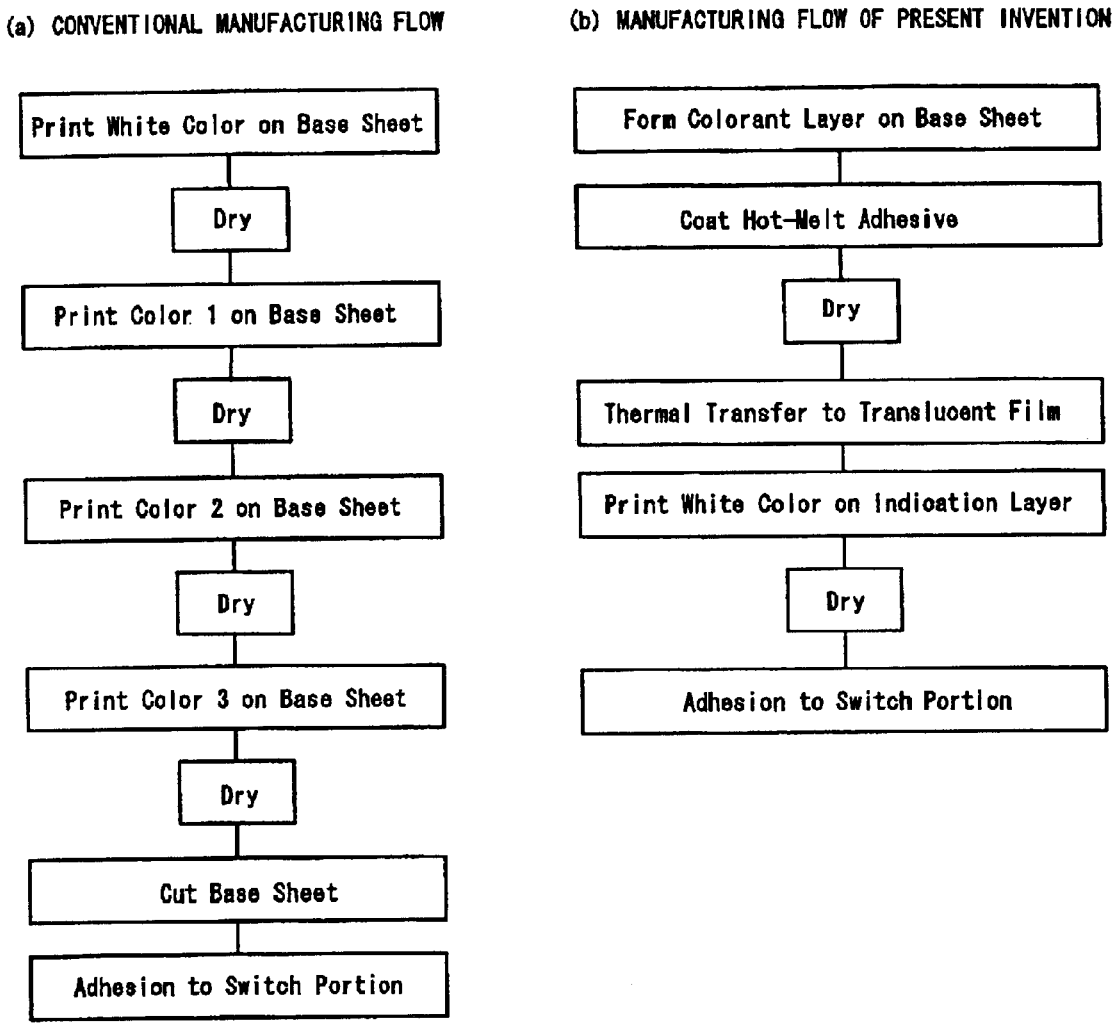
FIG. 15 is a flowchart that compares the indicator portion forming method for a membrane switch of the present invention and that for a membrane switch of the prior art.

FIG. 15 is a flowchart comparing the steps of forming an indicator layer in each of the pushbutton switch 50 according to Embodiment 5 and a pushbutton switch that is a conventional product. Now, assume a case where an indicator layer composed of three color materials and an auxiliary coloring layer of white color are provided on a surface of the flexible film. In this case, in the conventional product (a), the printing step is performed for each color, and further the drying step needs to be performed for each color. In contrast, according to the method of manufacturing the membrane switch 50 (b) of the present invention, the colorant layer 59 for indicating a letter, a symbol, a design, or the like can be formed in a single step, and the indicator layer 55 can be provided by performing thermal transfer thereof onto the translucent film 53 through the hot-melt adhesive, thus realizing a significant reduction in the number of steps. Obviously, the reduction in the number of manufacturing steps will become more pronounced as the number of colors used in a design increases.

(2) Materials of Respective Layers

Now, a description will be made of the materials of the respective portions that constitute the pushbutton switch or the membrane switch as an example of a push switch and the materials used for the manufacture thereof Note that, as for the switch portion 51 of the membrane switch 50, those materials which are used for the switch portion in a typical membrane switch may be employed. Likewise, materials used for a typical membrane switch may be also employed for portions of the membrane switch 60 other than the operation sheet 62 of the switch portion 61 and for the portions thereof described with reference to other embodiments.

Base Material Sheet 19, 29, 39, 49 and 58:

The indicator layer 13, 23, 33, 34, 55, 65 for indicating letters, symbols, patterns, and the like provided on the front or rear surface of the pushbutton-switch key top 11, 21, 31, 41 and on the rear surface of the operation sheet 52, 62 is formed of the colorant layer 18, 28, 38, 48, 59 to be printed on the base sheet 19, 29, 39, 49, 58, transferred from an output device that outputs color design data such as a printer. That is, the base sheet 19, 29, 39, 49, 58 is a sheet that serves as a substrate on which a color design image is formed, and is peeled off after the colorant layer 18, 28, 38, 48, 59 is transferred thereon. Therefore, it is not a constituent element of the pushbutton-switch key top 11, 21, 31, 41 or the operation sheet 52, 62 for the membrane switch 50, 60. A resin film or paper is used for the base sheet 19, 29, 39, 49, 58. Examples of the resin films that can be used include polyethylene terephthalate films, polybutylene terephthalate films, polyurethane films, polyamide films, polypropylene films, polystyrene films, fluoro resin films, ionomer films, polycarbonate films, and polyvinyl chloride films. Further, examples of the papers that can be used include art papers and coated papers. When a paper such as an art paper or a coated paper is used as the base sheet 19, 29, 39, 49, 58, ink may penetrate into the base sheet. In such a case, it is difficult to peel off the ink that has penetrated into the base sheet 19, 29, 39, 49, 58. Accordingly, a resin film is more preferable than a paper. The kind of the base sheet 19, 29, 39, 49, 58 to be used is selected from among the above-mentioned resin films and papers depending on the output device that forms the indicator layer 13, 23, 33, 43, 55, 65, such as a printer and on the characteristics of the colorant such as ink or toner. The base sheet 19, 29, 39, 49, 58 may have any thickness as far as it is within the range that allows printing to be performed by an output device that prints a color design image.

It is desirable that, on the surface of the base sheet 19, 29, 39, 49, 58, there is formed: a receiving layer on which a colorant such as ink and toner is easily adhered or carried thereon, according to the output device or the colorant used; or a release layer that serves to prevent the generation of burrs due to transfer and allow the colorant layer 18, 28, 38, 48, 59 to be easily transferred thereon or subjected to a surface treatment. Alternatively, it is desirable that the base sheet 19, 29, 39, 49, 58 itself is subjected to a surface treatment. In particular, in the case where the indicator layer 13, 23, 33, 43, 55, 65 is formed using an ink jet printer, it is preferable that the receiving layer (or release layer) be provided so as to improve the absorption of ink and make the printed dots be closer to regular circles.

Examples of such a receiving layer (or release layer) include an image bearing layer made of a porous material having a binding phase composed of inorganic fine particles bound by a binder resin. Since the image bearing layer, when ink is printed from a printer, allows the ink to penetrate into the pores, it has excellent ink absorption and also it prevents the flow of ink in the horizontal direction of the base sheet, thereby giving dots that are closer to regular circles, so that the indicator layer 13, 23, 33, 43, 55, 65 capable of indicating an image of high resolution can be obtained.

As the inorganic fine particles that form the image bearing layer, there can be used inorganic pigments such as inorganic oxides or hydrates thereof. Specific examples thereof include silica, alumina, alumina hydrate, and silica-alumina composites. An image bearing layer formed with boehmite, which agglomerates of alumina hydrate, or silica-alumina composite sol is preferable since it has a large pore volume and a large mean pore size so that it has excellent in ink absorption and also has excellent transparency, water resistance and glossiness. The mean particle size of the inorganic fine particles is 100 to 1,000 nm, preferably 200 to 800 nm. To increase the transparency of the image bearing layer, it is required to reduce the particle size of the fine particles to a range where substantially no light scattering will occur. In the case where the above-mentioned preferable particle size is used, the image bearing layer becomes opaque, so that even when it is used as a key top or an operation sheet of an illuminated type pushbutton switch, a sufficient light transmittance can be achieved. If the inorganic fine particles have a shape such that they assume a structure in which non-spherical fine particles are oriented to form linear pores, that is, if the image bearing layer has formed therein a large number of longitudinal pores that are open in the direction normal to the plane of the base sheet, then the ink absorption is further enhanced and the shape of dots become closer to regular circles and thus are more preferable.

Further, the binder that binds the inorganic fine particles includes starch and modified products thereof, polyvinyl alcohol and modified products thereof, cellulose derivatives, styrene/butadiene rubber latex, nitrile/butadiene rubber latex, and polyvinylpyrrolidone. Among these, polyvinyl alcohol and modified products thereof are preferable because they have excellent affinity for ink and relatively low glass transition temperature and thus gives satisfactory transferability.

The inorganic fine particles are combined with the binder to form an image bearing layer. The porous structure of the image bearing layer is preferably such that it has a mean pore size of 3 to 25 nm and a pore volume of 0.3 to 2.0 $cm^3/g$. In the case where the mean pore size is less than 3 nm or the pore volume is smaller than 0.3 $cm^3/g$, the penetration of ink becomes difficult. On the other hand, in the case where the mean pore size exceeds 25 nm or the pore volume exceeds 2.0 $cm^3/g$, dots close to regular circles are difficult to form and thus are not preferable.

The porous material having a binding phase composed of inorganic fine particles bound by a binder resin gives advantageous effects not only on improvement of the image quality but also on thermal transfer. That is, when a desired portion of the colorant layer 18, 28, 38, 48, 59 is to be transferred onto the key top side, if no such image bearing layer is present, the boundary surface between the site to be transferred and the site not to be transferred will not become sharp, thus resulting in poor exfoliation. In contrast, when such an image bearing layer is provided, the boundary surface between the surface to be transferred and the surface not to be transferred is made sharp and in addition the colorant layer 18, 28, 38, 48, 59 is separated neatly from the base sheet 19, 29, 39, 49, 58, so that the problem of a residual color does not occur.

The thickness of the image bearing layer is preferably sufficiently thick to allow penetration of a colorant such as ink printed by a printer, for example, 2 to 50 $\mu$m, preferably 7 to 45 $\mu$m. If the thickness of the layer is smaller than 7 $\mu$m, penetration of the ink becomes insufficient while if it is greater than 45 $\mu$m, thermal transfer cannot in some cases be performed neatly.

Indication Layer 13, 23, 33, 43, 55, 65

The indicator layer 13, 23, 33, 43, 55, 65 is a layer obtained by transferring the colorant layer 18, 28, 38, 48, 59, which has a letters, a symbol, a design pattern, or the like formed thereon by printing a color design image on the base sheet 19, 29, 39, 49, 58 using a printer, onto the key top main body 12, 22, 32, 42 or the translucent film 53, 63. The colorant layer 18, 28, 38, 48, 59 that serves as the basis of the indicator layer 13, 23, 33, 43, 55, 65 is formed using an output device that performs batch output of color design images. Atypical example of such an output device is a printer. While a printer may employ various printing systems such as the thermal transfer sublimation system, the ink jet system, or the laser-exposure thermal developing/transfer system, an ink jet printer is preferably used. This is because an ink jet printer allows full-color or high-speed printing to be easily performed, making it possible to obtain an image having excellent resolution and having an almost photograph-like image quality. Further, due to the provision of the above-mentioned image bearing layer, even if an ink for ink jet printing having poor in humidity resistance, weatherability, color developability, scratch resistance etc. is used, the ink is transferred together with the porous material while being infiltrated in the porous material, thereby making it possible to form the indicator layer 13, 23, 33, 43, 55, 65 which is excellent in humidity resistance, weatherability, color developability, scratch resistance etc.

When an image is to be directly printed on the basic material sheet 19, 29, 39, 49, 58 having no receiving layer (or release layer) provided thereon, the colorant material 18, 28, 38, 48, 59 composed of a colorant such as ink or toner of a printer is transferred to serve as the indicator layer 13, 23, 33, 43, 55, 65. On the other hand, in the case where the image bearing layer provided on the base sheet 19, 29, 39, 49, 58 serves to absorb the colorant so that the porous material and the colorant are transferred together, the transferred colorant material 18, 28, 38, 48, 59 inclusive of the porous material serves as the indicator layer 13, 23, 33, 43, 55, 65. In the case where a receiving layer or a release layer is provided other than the above-mentioned image bearing layer, as for the release layer, good resolution and transport property can be attained even if it remains on the base sheet 19, 29, 39, 49, 58 side without being transferred therefrom. However, as for the receiving layer, it is preferable from the viewpoints of resolution and transferability that the receiving layer does not remain on the base sheet 19, 29, 39, 49, 58 side.

While the colorant such as ink and toner allowing the expression of a color design image is determined in correspondence with the type of the output device used, ink or toner obtained by dispersing or dissolving pigment or dye in a binder resin is commonly used. For the indication of colors, the CMY system (cyan, magenta, and yellow), the CMYK system (cyan, magenta, yellow, and black), or the RGB system (red, green, and blue) is adopted for the colorant. With such a colorant, full color image representation can be performed by batch output using a color printer, so that a large number of fine letters or numerals, or complex figures, symbols, color patterns etc. can be indicated with sharp clarity in a small area of a key top, thereby forming an indicator portion that is excellent in terms of resolution representing the meticulousness, or preciseness of a drawing or the smoothness of an image.

The indicator layer 13, 23, 33, 43, 55, 65 obtained by transferring preferably has such a thickness which allows formation of a sufficient amount of the colorant layer 18, 28, 38, 48, 59 to enable indication of a color design image and does not hinder the transfer operation. In this example, such a thickness is 1 to 50 $\mu$m.

Figure 16:
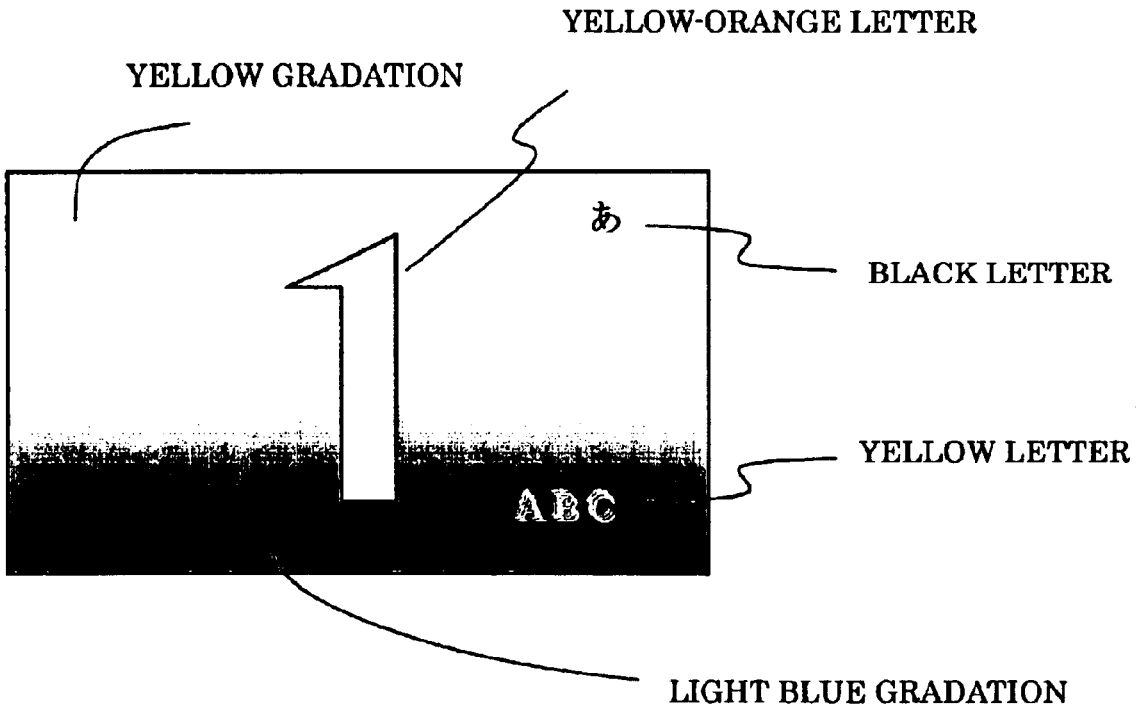
FIG. 16 is a plan view of a push switch according to an embodiment of the present invention.
Figure 17:
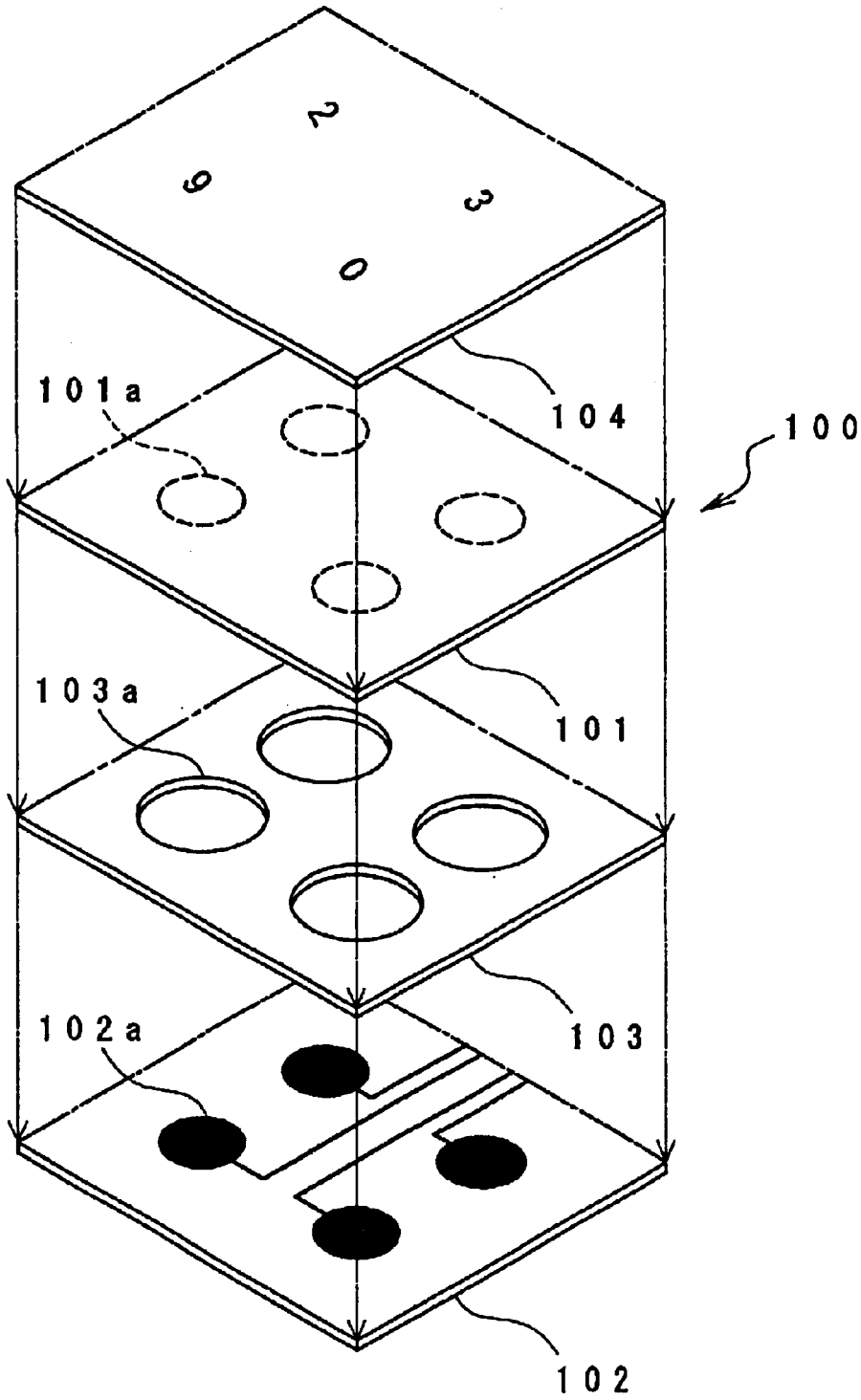
Fig.17 (Prior Art)
FIG. 17 is an exploded perspective view of a conventional membrane switch.
Figure 18:
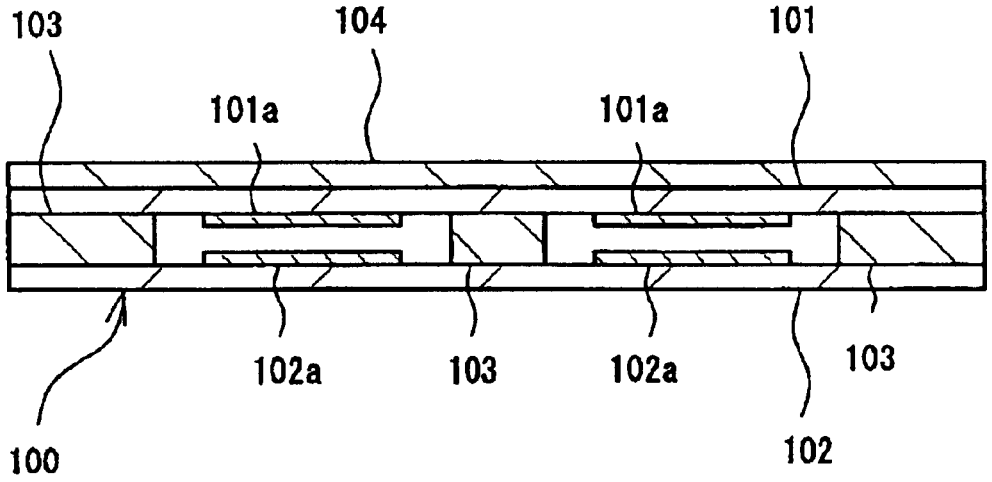
Fig.18 (Prior Art)
FIG. 18 is a longitudinal sectional view of the conventional membrane switch.

With the indicator layer 13, 23, 33, 43, 55, 65 obtained by transferring the colorant layer 18, 28, 38, 48, 59 that is obtained by printing a color design image using a color printer, for example, an indicator portion having such a design in which, as shown in FIG. 16, yellow letters, yellow-orange letters, black letters etc. appear against gradations of yellow and light blue can be formed in a single printing step, thereby making it possible to prepare the pushbutton switch 10, 20, 30, 40 or the membrane switch 50, 60 having a meticulous design formed thereon.

Adhesive Layer 15, 25, 35, 45 and First Adhesive Layer 54, 64

For the adhesive layer 15, 25, 35, 45 for binding the indicator layer 13, 23, 33, 43 to the key top main body 12, 22, 32, 43, or for the first adhesive layer 54, 64 for binding the indicator layer 54 to the translucent film 53, 63, a pressure-sensitive adhesive is used, or an adhesive in the case where the colorant layer 18, 28, 38, 48, 59 is pressure-transferred, whereas a hot-melt adhesive is preferably used in the case where they are thermally transferred. Examples of the hot-melt adhesive include acrylic-based, polyvinyl chloride-based, polyester-based, and urethane-based hot-melt adhesives. Among these hot-melt adhesive, preferred are those adhesives that have glass transition temperatures of 50 to 100° C. in view of excellent transferability.

The pressure-sensitive adhesive or the adhesive that serves as the adhesive layer 15, 25, 35, 45 as well as the first adhesive layer 54, 64 is uniformly coated partially or entirely on the key top main body 2, 22, 32, 42 or on the translucent film 53, 63, or on the colorant layer 18, 28, 38, 48, 59 formed on the base sheet 19, 29, 39, 49, 58 by printing or coating. If a key top of an illuminated type pushbutton switch or an illuminated type membrane switch is to be produced, light must be transmitted and hence the pressure-sensitive adhesive or adhesive is preferably transparent or semi-transparent. The pressure-sensitive adhesive or adhesive may also be colored, increasing the flexibility in design expression. Further, addition of various additives such as ultraviolet absorbents and stabilizers enables improvement of the weatherability to a greater extent. Such an adhesive and the like preferably has satisfactory adhesiveness with respect to the key top main body 12, 22, 32, 43 or the translucent film 53, 63 serving as adherends. The adhesive layer 15, 25, 35, 45 as well as the first adhesive layer 54, 64 may have any thickness sufficient for transferring the colorant layer 18, 28, 38, 48, 59 to the key top main body 12, 22, 32, 42 or the translucent film 53, 63, and have generally a thickness in the range of 1 to 30 $\mu$m.

Auxiliary Coloring Layer 14, 24, 34, 44, 56:

The difficulty of expressing metallic colors like gold or silver, a white color, a pearl color and the like by a color printer is overcome by forming the auxiliary coloring layers 14, 24, 34, 44 and 56 for adding these colors. That is, the auxiliary coloring layer 14, 23, 34, 44, 56 of white, silver or the like color are provided as laminated on the colorant layer 18, 28, 38, 48, 59. It is preferable that at least one ink selected from the group consisting of acrylic-based, polyvinyl chloride-based, urethane-based, ester-based, and epoxy-based inks is used for the auxiliary coloring layer 14, 24, 34, 44, 56. The auxiliary coloring layer 14, 24, 34, 44, 56 is preferably translucent when switches of the illuminated type are to be produced. The thickness of the auxiliary coloring layer 14, 24, 34, 44, 56 is preferably 1 to 30 $\mu$m. If the thickness is less than 1 $\mu$m, the effect of adding such colorations as white, silver etc is insufficient. On the other hand, if the thickness is above 30 $\mu$m, not only the color adding effect does not increase any more but also the translucency thereof is aggravated. However, in the case where the auxiliary coloring layer 44 is provided on the base sheet 49 side and the auxiliary coloring layer 44 is also transferred to the key top body 43 as shown in Embodiment 4, it is preferred that the auxiliary coloring layer has a smaller thickness from the viewpoint of its transferability.

Key Top Main Body 12, 22, 32, 42:

The key top main body 12, 22, 32, 42, which constitutes a part of the pushbutton switch 10, 20, 30, 40, refers to the portion of the substrate of the key top 11, 21, 31, 41 exclusive of various functional layers such as the indicator layer 13, 23, 33, 43 and the adhesive layer 15, 25, 35, 45. Mainly a resin is used for the key top main body 12, 22, 32, 42. The resin is a transparent or semi-transparent resin in Embodiment 1 and may be a resin other than the translucent resin in other embodiments, except for the case where a pushbutton switch of the illuminated type is to be produced. The reasons for the above are as follows. In the case of the pushbutton-switch key top 11, 21, 31, 41 of the illuminated type, light must transmit through the key top main body 12, 22, 32, 42, so that the resin must be translucent. On the contrary, in Embodiments 2 though 4, the indicator layer 23, 33, 43 is formed on the surface of the key top main body 22, 32, 43, so that the key top main body 22, 32, 42 needs not be transparent or semi-transparent in order for the indicator portion to be visually recognized.

Examples of the resin that can be used for the key top main body 12, 22, 32, 42 include, for example, various kinds of thermoplastic resins, thermosetting resins, moisture curing resins, and photocuring resins, such as polyester resins, polycarbonate resins, polymethyl methacrylate resins, polyurethane resins, polyamide resins, silicone resins, acrylic resins, and epoxy resins. The key top main body 12, 22, 32, 42 is produced by filling a heat molten resin or a liquid uncured resin in a mold having a desired shape and solidifying it by injection molding, compression molding, transfer molding, rotation molding or the like.

Key Pad 17, 27, 37, 47:

The pushbutton-switch key top 11, 21, 31, 41, on which the indicator layer 13, 23, 33, 43 is formed is integrally bonded to the key pad 17, 27, 37, 47, with rubber-like resilient material, for example, natural rubber, styrene-butadiene rubber, silicone rubber, ethylene/propylene rubber, or a thermoplastic elastomers (hereinafter referred to as "TPE"), for example, styrene-based TPEs, olefin-based TPEs, ester-based TPEs, or urethane-based TPEs to produce the pushbutton switch 10, 20, 30, 40.

Translucent Films 53, 63:

Translucent film 53, 63 that constitutes the operation sheet 52, 62 used for the membrane switch 50, 60 has a function of protecting the indicator layer 55, 65. A resin film having light-transmitting property, such as those films made of resins, for example, polyethylene terephthalate films, polybutylene terephthalate films, polyurethane films, polyamide films, polypropylene films, polystyrene films, fluoro resin films, ionomer films, polycarbonate films, and polyvinyl chloride films, can be used for the translucent film. The thickness of the translucent film 53, 63 is 25 to 200 μm, including situation where they are used in large-scale appliances. However, where a reduction in thickness is desired, the thickness of the translucent film is set to 25 to 100 μm. If the film thickness is smaller than 25 μm, the protection of the indicator layer 55, 65 is insufficient. On the other hand, a film thickness greater than 200 μm has poor transparency, and is not preferable for a membrane switch that is required to have a small thickness, and in addition the operating feel and the operational accuracy thereof becomes poor so that the switch cannot perform its switch function in a satisfactory manner.

Second Adhesive Layer 57

In the membrane switch 50, the second adhesive layer 57 for adhering the operation sheet 52 and the switch portion 51 together is a layer having the function of adhering the operation sheet 52, which is composed of the translucent film 53, the first adhesive layer 54, the indicator layer 55, and, as occasion demands, the auxiliary coloring layer 56, onto the flexible film 51*c* of the switch portion 51. In addition to a commonly used adhesive, an adhesive tape or the like may be used for the second adhesive layer 57.

EXAMPLES

Hereinbelow, the present invention will be described by way of examples and comparative examples. It is to be understood, however, that those examples of the present invention should not be construed restrictively.

Examples 1 through 4 of the invention relate to a pushbutton switch, and more specifically to the manufacture of its key top. Further, Example 5 and Comparative Example 1 relate to a membrane switch.

Example 1

FIG. 1 and FIGS. 2A through 2E

On a predetermined base sheet 19, color design data prepared by using a personal computer is printed by using a predetermined printer, thereby forming a colorant layer 18 on the base sheet 19. In this case, there are also prepared samples in which a predetermined receiving layer (not shown) is provided on the base sheet 19. A predetermined translucent hot-melt adhesive layer 15 is uniformly coated by screen printing at a thickness of 5 μm on the back surface 12*a* of a key top main body 12 made of a polycarbonate resin formed by injection molding or on the colorant layer 18, and is then dried to cure. Thereafter, the key top main body 12 and the base sheet 19 are aligned such that the colorant layer 18 is transferred on the back surface 12*a* side of the key top main body. Then, the key top main body 12 and the base sheet 19 are pressed against each other under the pressure of 0.3 MPa and thermal transfer is effected under application of a predetermined temperature for 2 seconds. Thereafter, the base sheet 19 is peeled off, thereby forming an indicator layer 13 on the back surface 12*a* of the key top main body 12. Depending on the sample used, a predetermined auxiliary coloring layer 14 is coated at a thickness of 5 μm on the indicator layer 13. Thus, a pushbutton-switch key top 11 corresponding to each of Samples 1 through 11 is obtained. The materials and manufacturing conditions employed in this case are shown in Tables 1 and 2.

TABLE 1

Materials and manufacturing conditions employed for respective samples

| | Example 1 | | | | | |
|---|---|---|---|---|---|---|
| Sample No. | Sample 1 | Sample 2 | Sample 3 | Sample 4 | Sample 5 | Sample 6 |
| Recipient layer | Boehmite/PVA | Xerogel/PVA | Xerogel/PVA | Xerogel/PVA | Xerogel/PVA | Xerogel/PVA |
| Hot-melt adhesive layer | Acrylic | Acrylic | Acrylic | Acrylic | Urethane | Acrylic |
| Auxiliary coloring layer | None | None | Acrylic | None | Acrylic | Urethane |
| Printer type | Ink jet | Ink jet | Ink jet | Ink jet | Thermal transfer | Thermal transfer |
| Base sheet (thickness) | PET (100 μm) | PET (100 μm) | PET (100 μm) | PET (100 μm) | Polycarbonate (100 μm) | Polycarbonate (100 μm) |
| Coating surface for hot-melt adhesive layer | Back surface of key top main body | Colorant layer | Back surface of key top main body | Back surface of key top main body | Back surface of key top main body | Back surface of key top main body |
| Transfer temperature | 220° C. | 220° C. | 220° C. | 200° C. | 200° C. | 200° C. |
| Layer structure | FIG. 1 | FIG. 1 | FIG. 1 | FIG. 1 | FIG. 1 | FIG. 1 |

TABLE 2

Materials and manufacturing conditions employed for respective samples

| | Example 1 | | | | |
|---|---|---|---|---|---|
| Sample No. | Sample 7 | Sample 8 | Sample 9 | Sample 10 | Sample 11 |
| Recipient layer | Polyester/PVA | Polyester/PVA | None | None | None |
| Hot-melt adhesive | Acrylic | Acrylic | Acrylic | Acrylic | Acrylic |

TABLE 2-continued

| Materials and manufacturing conditions employed for respective samples | | | | | |
|---|---|---|---|---|---|
| | Example 1 | | | | |
| Sample No. | Sample 7 | Sample 8 | Sample 9 | Sample 10 | Sample 11 |
| layer | | | | | |
| Auxiliary coloring layer | Acrylic | None | Acrylic | Acrylic | Acrylic |
| Printer type | Ink jet | Ink jet | Ink jet | Laser-exposure thermal developing/ transfer | Thermal transfer |
| Base sheet (thickness) | PET (100 μm) | PET (100 μm) | Acryl (100 μm) | PET (100 μm) | PET (100 μm) |
| Coating surface for hot-melt adhesive layer | Back surface of key top main body | Colorant layer | Back surface of key top main body | Back surface of key top main body | Back surface of key top main body |
| Transfer temperature | 220° C. | 220° C. | 220° C. | 220° C. | 220° C. |
| Layer structure | FIG. 1 | FIG. 1 | FIG. 1 | FIG. 1 | FIG. 1 |

In Tables 1 and 2, used for the PET film serving as the base sheet is LUMIRROR (from Toray Industries. Inc.), used for the polycarbonate film is MAKROFOL (from Bayer Ltd.), and used for the acrylic film is ACRYPLEN HBS001 (from Mitsubishi Rayon Co., Ltd.). As the receiving layer, one of the following is used: an image bearing layer formed of a porous material having a binding phase composed of boehmite that is bound by polyvinyl alcohol; an image bearing layer formed of a porous material obtained by binding xerogel, which is obtained by removing a solvent from silica/alumina composite sol, by polyvinyl alcohol; and a receiving layer formed of polyvinyl alcohol resin/polyester resin (NS-244LX (Takamatsu Oil & Fat Co., Ltd.) formed on the base sheet 19 at a thickness of 25 μm. Further, specific examples of the materials etc indicated in Tables 1 and 2 may be given as follows. That is, SNAP ink (from Jujo Chemical Co., Ltd.) and SG740 ink (from Seiko Advance Ltd.) are used for the "acrylic" hot-melt adhesive and the "urethane" hot-melt adhesive, respectively. Further, STR ink (from Seiko Advance Ltd.) and SG410 ink (from Seiko Advance Ltd.) are used for the "acrylic" auxiliary coloring layer and the "urethane" auxiliary coloring layer, respectively. Further, as for the "ink jet" printer, PM890 (from Seiko Epson Corporation) is used, except that SOLJET SJ-500 (from Roland DG Corporation) is used for Sample 9. For the "thermal transfer" printer and the "laser-exposure thermal developing/transfer" printer, MD5000 (from Alps Electric Co., Ltd.) and Docuprint C 620 (from Fuji Xerox Co., Ltd.) are used, respectively. As for the printer ink, pure ink for use in each type of the printers is used. Note that, with regard to Samples 1, 2, 4, and 8 having no auxiliary coloring layer 14, for convenience of comparison, it is indicated in Tables 1 and 2 that each of those Samples has a layer structure corresponding to that of FIG. 1. To be precise, however, the layer structure of each of those Samples corresponds to the structure of FIG. 3 from which the auxiliary coloring layer 14 is omitted.

Example 2

FIG. 3 and FIGS. 4A through 4E

On a predetermined base sheet 29, color design data prepared by using a personal computer is printed by using a color printer employing a predetermined printing system, thereby forming a colorant layer 28 on the base sheet 29 having a predetermined receiving layer (not shown) provided thereon. Depending on the sample used, a predetermined auxiliary coloring layer 24 is uniformly coated at a thickness of 5 μm on a surface 22*a* of a key top main body 22 made of a polycarbonate resin formed by an injection molder. Then, a predetermined translucent hot-melt adhesive 25 is uniformly coated by screen-printing on the colorant layer 28 or on the surface 22*a* of the key top main body 22, and is then dried to cure. The key top main body 22 and the base sheet 29 are aligned such that the colorant layer 28 is transferred on the key top 22 side. Then, the key top main body 22 and the base sheet 29 are pressed against each other under the pressure of 0.3 MPa and thermal transfer is effected under application of a predetermined temperature for 2 seconds. Thereafter, the base sheet 29 is peeled off, thus obtaining a pushbutton-switch key top 21 corresponding to each of Samples 12 and 13. The materials and manufacturing conditions employed in this case are shown in Table 3. Note that, with regard to Sample 13 having no auxiliary coloring layer 24, for convenience of comparison, it is indicated in Table 3 that the layer structure thereof corresponds to that of FIG. 3. To be precise, however, the layer structure of Sample 13 corresponds to the structure of FIG. 3 from which the auxiliary coloring layer 24 is omitted.

TABLE 3

| Materials and manufacturing conditions employed for respective samples | | | | |
|---|---|---|---|---|
| | Example 2 | | Example 3 | Example 4 |
| Sample No. | Sample 12 | Sample 13 | Sample 14 | Sample 15 |
| Recipient layer | Xerogel/PVA | Xerogel/PVA | Xerogel/PVA | Xerogel/PVA |
| Hot-melt adhesive layer | Acrylic | Urethane | Acrylic | Acrylic |

TABLE 3-continued

Materials and manufacturing conditions employed for respective samples

| | Example 2 | | Example 3 | Example 4 |
|---|---|---|---|---|
| Sample No. | Sample 12 | Sample 13 | Sample 14 | Sample 15 |
| Auxiliary coloring layer | Acrylic | None | Acrylic | Acrylic |
| Printer type | Ink jet | Laser-exposure thermal developing/transfer | Ink jet | Ink jet |
| Base sheet (thickness) | PET (100 μm) | PET (100 μm) | PET (100 μm) | PET (100 μm) |
| Coating surface for hot-melt adhesive layer | Colorant layer | Front surface of key top main body | Colorant layer | Colorant layer |
| Transfer temperature | 220° C. | 200° C. | 220° C. | 220° C. |
| Layer structure | FIG. 3 | FIG. 3 | FIG. 5 | FIG. 7 |

In Table 3, where the same descriptions as those of Tables 1 and 2 are given, the materials described in Table 1 also apply to Table 3.

Example 3

FIG. 5 and FIGS. 6A through 6E

Sample 14 is obtained in the same manner as Sample 12 except that the auxiliary coloring layer 24 is provided on the back surface 32*a* of a key top main body 32, instead of providing it on the front surface 22*a* of the key top main body 22 as in Sample 12 of Example 2.

Example 4

FIG. 7 and FIGS. 8A through 8E

Sample 15 is obtained in the same manner as Sample 12 except that, instead of providing the auxiliary coloring layer 24 on the front surface 22*a* of the key top main body 22 as in Sample 12 of Example 2, an auxiliary coloring layer 44 is provided by coating on the front surface of a colorant layer 48 and a hot-melt adhesive 45 is provided by coating on the auxiliary coloring layer 44 provided on the colorant layer 48.

Example 5

FIG. 10

On a base sheet 58 consisting of a PET film or an acrylic film having a thickness of 100 μm and provided with a predetermined image bearing layer, color design data prepared by using a personal computer is printed by using a predetermined printer, thereby forming a colorant layer 59 on the base sheet 58. On the colorant layer 59, a predetermined translucent hot-melt adhesive layer 53 is uniformly coated by screen printing at a thickness of 5 μm and is then dried to cure. Then, alignment is performed so that the colorant layer 59 is transferred onto the translucent film 53 in good conformity with the predetermined translucent layer 53 having a thickness of 50 μm. The base sheet 58 and the translucent film 53 are then pressed against each other under the pressure of 0.3 MPa and thermal transfer is conducted at 200° C. for 2 seconds. Thereafter, the base sheet 58 is peeled off, thereby forming an indicator layer 53 on the front surface of the translucent film 53. Depending on the sample used, a predetermined auxiliary coloring layer 56 is coated at a thickness of 5 μm on the indicator layer 55. The operation sheet 52 thus obtained is adhered onto a flexible film 51 of a switch portion 51 using a light-transmissive double-faced tape 55 having a thickness of 150 μm, thereby obtaining a membrane switch corresponding to each of Samples 16 through 22. The materials and manufacturing conditions employed in this case are shown in Tables 4 and 5.

TABLE 4

Materials and manufacturing conditions employed for respective samples

| | Example 5 | | | | |
|---|---|---|---|---|---|
| Sample No. | Sample 16 | Sample 17 | Sample 18 | Sample 19 | Sample 20 |
| Recipient layer (thickness) | Xerogel/PVA (20 μm) | Boehmite/PVA (15 μm) | Xerogel/PVA (20 μm) | Polyester/PVA (20 μm) | Polyester/PVA (20 μm) |
| Hot-melt adhesive layer | Acrylic | Urethane | Acrylic | Acrylic | Acrylic |
| Translucent film | Polycarbonate film | Polyester film | Polycarbonate film | Polycarbonate film | Polycarbonate film |
| Auxiliary coloring layer | None | Acrylic | Acrylic | None | Acrylic |
| Printer type | Ink jet | Thermal transfer/ sublimation | Ink jet | Ink jet | Ink jet |
| Base sheet | PET | PET | PET | PET | PET |

TABLE 4-continued

| Materials and manufacturing conditions employed for respective samples | | | | | |
|---|---|---|---|---|---|
| | Example 5 | | | | |
| Sample No. | Sample 16 | Sample 17 | Sample 18 | Sample 19 | Sample 20 |
| Provision of base sheet as component of membrane switch | None | None | None | None | None |
| Viewing direction of indicator layer | Printing surface side | Printing surface side | Printing surface side | Printing surface side | Printing surface side |
| Transfer temperature | 200° C. | 200° C. | 200° C. | 200° C. | 200° C. |

TABLE 5

| Materials and manufacturing conditions employed for respective samples | | | | | |
|---|---|---|---|---|---|
| | Example 5 | | | Comparative Example 1 | |
| Sample No. | Sample 21 | Sample 22 | Sample 23 | Sample 24 | Sample 25 |
| Recipient layer (thickness) | None | None | None | Xerogel/PVA (20 μm) | Xerogel/PVA (20 μm) |
| Hot-melt adhesive layer | Acrylic | Acrylic | Acrylic | Acrylic | Acrylic |
| Translucent film | Polycarbonate film | Polycarbonate film | Polycarbonate film | Polycarbonate film | Polycarbonate film |
| Auxiliary coloring layer | Acrylic | Acrylic | Acrylic | None | None |
| Printer type | Ink jet | Laser-exposure thermal developing/transfer | Thermal transfer | Ink jet | Ink jet |
| Base sheet | Acryl | PET | PET | PET | PET |
| Provision of base sheet as component of membrane switch | None | None | None | Provided | Provided |
| Viewing direction of indicator layer | Printing surface side | Printing surface side | Printing surface side | Printing surface side | Side opposite to printing surface |
| Transfer temperature | 200° C. | 200° C. | 200° C. | Not transferred | Not transferred |

In Tables 4 and 5, used for the PET film serving as the base sheet is LUMIRROR (from Toray Industries. Inc.), and used for the acrylic film is ACRYPLEN HBS001 (from Mitsubishi Rayon Co., Ltd.). As the receiving layer, one of the following is used: an image bearing layer formed of a porous material having a binding phase composed of boehmite that is bound by polyvinyl alcohol; an image bearing layer formed of a porous material obtained by binding xerogel, which is obtained by removing a solvent from silica/alumina composite sol, by polyvinyl alcohol; and a receiving layer formed of polyvinyl alcohol resin/polyester resin (NS-244LX (Takamatsu Oil & Fat Co., Ltd.)) formed on the base sheet 58. Further, specific examples of the materials etc indicated in Tables 4 and 5 may be given as follows. That is, SNAP ink (from Jujo Chemical Co., Ltd.) and SG740 ink (from Seiko Advance Ltd.) are used for the "acrylic" hot-melt adhesive and the "urethane" hot-melt adhesive, respectively. Further, STR ink (from Seiko Advance Ltd.) is used for the "acrylic" auxiliary coloring layer. Further, as for the "ink jet" printer, PM890 (from Seiko Epson Corporation) is used, except that SOLJET SJ-500 (from Roland DG Corporation) is used for Sample 21. For the "thermal transfer" printer, the "laser-exposure thermal developing/transfer" printer, and the "thermal transfer sublimation" printer, MD5000 (from Alps Electric Co., Ltd.), Docuprint C620 (from Fuji Xerox Co., Ltd.), and CAMEDIA P-400 (from Olympus Optical Co., Ltd.) are used, respectively. As for the printer ink, pure ink for use in each type of the printers is used.

Comparative Example 1

On a base sheet consisting of a PET film having a thickness of 100 μm and provided with a predetermined image bearing layer, color design data prepared by using a personal computer is printed by using a predetermined printer, thereby forming a colorant layer on the base sheet. On the colorant layer, a predetermined translucent hot-melt adhesive is uniformly coated by screen printing at a thickness of 5 μm and then dried to cure. Then, the hot-melt adhesive is melted at 200° C. and adhered onto a predetermined translucent film having a thickness of 50 μm, thereby obtaining an operation sheet formed of the base sheet and the translucent film which are joined together. Thereafter, the operation sheet is adhered onto a flexible film using a light-transmissive double-faced tape. Sample 24 is obtained by joining the base sheet side of the operation sheet to the flexible film, and Sample 25 is obtained by joining the translucent film side of the operation sheet to the flexible film. The materials and manufacturing conditions employed in this case are shown in Table 5.

With respect to Samples 1 through 15 obtained in Examples 1 through 4, evaluations are performed on printing property (resolution), transferability, storage stability, and image quality (color reproducibility). As for the printing property, based on the indication image obtained after the transfer, samples with a very good resolution are marked "A", samples with a good resolution are marked "B", and samples with a resolution equivalent to that obtained by conventional screen-printing or the like are marked "C".

With regard to the transferability, samples in which a transfer portion and a non-transfer portion can be sharply peeled off from each other at the boundary therebetween, with no transfer residue remaining on the base sheet, are marked "A"; samples in which the transfer portion and the non-transfer portion can be sharply peeled off from each other but transfer residue remains on the base sheet are marked "B"; and samples in which burrs are generated on the boundary between the transfer portion and the non-transfer portion are marked "C". Further, the storage stability is evaluated on the basis of a humidity resistance test (45° C., 95% RH, 120 hours), and samples in which the image quality does not change from that of the initial image are marked "A"; samples in which there is even a slight change in the image quality from that of the initial image are marked "B"; and samples in which the image quality is clearly reduced from that of the initial image are marked "C". As for the image quality (color reproducibility), samples in which full-color representation of a near photograph quality is achieved are marked "A"; samples in which some slight color fading is observed depending on the hue are marked "B"; and samples with inferior image quality are marked "C". The results are shown in Table 6. In addition to those evaluation items, evaluations are made with respect to the operating feel and operational accuracy. With regard to the operating feel, samples in which a clear depressing sensation is obtained when performing a depressing operation on the switch are marked "A"; samples in which such a sensation is obtained more or less are marked "B"; and samples in which almost no such sensation is obtained are marked "C". As for the operational accuracy, samples in which on-off switching is effected for a switch with accuracy when performing a depressing operation on the switch are marked "A"; samples in which the switching is not effected in some rare cases are marked "B"; and samples in which the switching is frequently not effected are marked "C". The results are shown in Table 7.

TABLE 6

Evaluation results of respective samples

| Sample No. | Example No. | Printing property | Transferability | Storage stability | Image quality (color reproducibility) |
|---|---|---|---|---|---|
| Sample 1 | Example 1 | A | A | A | B |
| Sample 2 | Example 1 | A | A | A | B |
| Sample 3 | Example 1 | A | A | A | A |
| Sample 4 | Example 1 | A | A | A | B |
| Sample 5 | Example 1 | A | A | A | A |
| Sample 6 | Example 1 | A | A | A | A |
| Sample 7 | Example 1 | B | B | C | A |
| Sample 8 | Example 1 | B | B | C | B |
| Sample 9 | Example 1 | B | C | C | B |
| Sample 10 | Example 1 | B | C | B | B |
| Sample 11 | Example 1 | B | C | B | B |
| Sample 12 | Example 2 | B | A | A | A |
| Sample 13 | Example 2 | B | A | A | B |
| Sample 14 | Example 3 | B | A | A | A |
| Sample 15 | Example 4 | B | A | A | A |

TABLE 7

Evaluation results of respective samples

| Sample No. | Example No. | Printing property | Transfer property | Storage stability | Image quality (color reproducibility) | Operating feel | Operational accuracy |
|---|---|---|---|---|---|---|---|
| Sample 16 | Example 5 | A | A | A | B | A | A |
| Sample 17 | Example 5 | A | A | A | A | A | A |
| Sample 18 | Example 5 | A | A | A | A | A | A |
| Sample 19 | Example 5 | B | B | C | B | A | A |
| Sample 20 | Example 5 | B | B | C | A | A | A |
| Sample 21 | Example 5 | B | C | C | B | A | A |
| Sample 22 | Example 5 | B | C | B | B | A | A |
| Sample 23 | Example 5 | B | C | B | B | A | A |
| Sample 24 | Comparative Example 1 | A | — | A | B | C | C |
| Sample 25 | Comparative Example 1 | B | — | A | B | C | C |

Samples 1 through 6 according to Example 1, which are constructed such that a color design image outputted by a printer can be viewed from the front side (the printing surface side), and Samples 16 through 18 according to Example 5 are superior in terms of printing property to Samples 12 through 15, and 22, which are constructed such that the color design image is viewed from the back side (the side opposite to the printing surface). Further, Samples 1 through 6, and 12 through 18 in which an image bearing layer, which is formed of a porous material having a binding phase composed of inorganic particles that are bound by a binder resin, is provided on the base sheet and the image bearing layer is transferred altogether to serve as the indicator layer, are particularly excellent in terms of transferability and storage stability. Further, Samples 3, 5 though 7, 12, 14, 15, 17, 18, and 20 each having the auxiliary coloring layer provided therein are particularly excellent in terms of image quality (color reproducibility). In this case, the evaluation on the image quality is "B" for Samples 9 through 11, and 21 through 23 presumably because no receiving layer is provided therein. Also, Samples 24 and 25 in which the base sheet is used as the operation sheet without being peeled off are clearly inferior in terms of operating feel and operational accuracy.

The pushbutton switch according to the present invention has an indicator layer in which a large number of letters, symbols etc can be indicated and fine, complex picture patterns, color designs etc can be represented, which is excellent in terms of resolution as well as design property.

The membrane switch according to the present invention has an indicator layer in which letters, symbols, complex picture patterns, color designs etc can be indicated with sharp clarity and which is excellent in terms of resolution and design property. The membrane switch provides a good operating feel, making it less prone to depressing operation errors.

Further, the indicator portion forming method for a push switch according to the present invention, in which the indicator layer is formed using an ink jet printer, obviates the need to perform steps such as conventional printing steps regardless of whether a single color image or a multi-color image is to be formed, making it possible to produce push switches inexpensively irrespective of the production quantity thereof without causing the problems of the skill, misregistration, intrusion of foreign matters etc. associated with the use of printing techniques. Further, the push switch according to the present invention, in which the indicator layer having the colorant infiltrated in the image bearing layer is formed, is a push switch having an indicator layer that allows for high image quality and has high water resistance. Further, the push switch according to the present invention is formed by performing thermal transfer of the indicator layer onto the resin serving as a transfer medium with a transparent or semi-transparent hot-melt adhesive, whereby there is no need to perform such post-processing as cutting the printing sheet into a desired shape, thereby allowing easy and high-yield production of the push switch.

What is claimed is:

1. An indicator portion forming method for a push switch, in which an indicator portion indicating a color design image including a letter, a pattern, and a design is formed on the push switch, the method comprising:

forming a colorant layer by printing a color design image on a base sheet by a printer;

transferring the colorant layer to a transfer resin through an adhesive, the transfer resin constituting a surface of the push switch; and forming an indicator layer on the transfer resin by peeling off the base sheet and using the colorant layer as the indicator layer.

2. An indicator portion forming method for a push switch according to claim 1, wherein the push switch is a pushbutton switch having a key top made of a resin, and the transfer resin is a key top main body of the pushbutton switch.

3. An indicator portion forming method for a push switch according to claim 1, wherein the push switch is a membrane switch comprising: an operation sheet which is provided with the indicator layer indicating the color design image including the letter, the pattern, and the design and on which a depressing operation is performed; and a switch portion having contact electrodes provided in opposed positions, the switch portion executing a predetermined switch function when the contact electrodes that are insulated from each other are brought into conduction by the depressing operation on the operation sheet, and wherein the transfer resin is a translucent film constituting a part of the operation sheet.

4. An indicator portion forming method for a push switch according to claim 1, wherein the transfer resin is formed of a transparent or semi-transparent resin and the colorant layer is transferred to a back surface of the transfer resin.

5. An indicator portion forming method for a push switch according to claim 1, wherein the base sheet has an image bearing layer and the colorant layer is formed by printing the color design image on the image bearing layer by the printer.

6. An indicator portion forming method for a push switch according to claim 5, wherein the image bearing layer is formed of a porous material which has a binding phase composed of inorganic particles that are bound by a binder resin and in which a large number of longitudinal slits opening in a direction normal to a plane of the base sheet are formed.

7. An indicator portion forming method for a push switch according to claim 1, further comprising forming an auxiliary coloring layer for adding such colorations as metallic colors including gold and silver, or a white color.

8. An indicator portion forming method for a push switch according to claim 1, wherein the adhesive is a transparent or semi-transparent hot-melt adhesive and the transfer of the colorant layer is effected by thermal transfer.

9. An indicator portion forming method for a push switch according to claim 1, wherein the color design image is printed by using a printer employing an ink jet printing system.

10. A push switch which has an indicator portion indicating a color design image including a letter, a pattern, or a design, comprising an indicator layer which is obtained by printing a color design image by a printer through an adhesive layer, on a surface of the push switch.

11. A push switch according to claim 10, wherein the push switch is used as a pushbutton switch having a key top made of a resin.

12. A push switch according to claim 10, wherein the push switch is used as a membrane switch comprising: an operation sheet which is provided with the indicator layer indicating the color design image including the letter, the pattern, or the design and on which a depressing operation is performed; and a switch portion having contact electrodes provided in opposed positions, the switch portion executing a predetermined switch function when the contact electrodes that are insulated from each other are brought into conduction by the depressing operation on the operation sheet.

13. A push switch according to claim 12, wherein the push switch is used as the membrane switch in which the operation sheet constitutes a part of the switch portion and the contact electrodes are formed on the operation sheet.

14. A push switch according to claim 10, wherein the surface of the push switch is formed of a translucent resin and the indicator layer is formed on a back surface of the resin.

15. A push switch according to claim 10, wherein the indicator layer is formed by transferring a colorant layer to a transfer resin constituting a part of the push switch, the colorant layer being formed by printing the colorant layer on a base sheet having a porous image bearing layer by the printer and impregnating ink into the image bearing member.

16. A push switch according to claim 15, wherein the image bearing layer is formed of a porous material which has a binding phase composed of inorganic particles that are bound by a binder resin and in which a large number of longitudinal pores opening in a direction normal to a plane of the base sheet are formed.

17. A push switch according to claim 10, further comprising an auxiliary coloring layer for adding such colorations as metallic colors including gold and silver, or a white color.

18. A push switch according to claim 10, wherein the adhesive layer is formed of a transparent or semi-transparent hot-melt adhesive.

19. A push switch according to claim 10, wherein the indicator layer obtained by transferring the colorant layer printed by an ink jet printer.

20. A push switch according to claim 10, wherein each of the layers is translucent so that light exiting from an inner light source can be transmitted therethrough to the exterior for illumination.

* * * * *